US011998120B2

(12) United States Patent
Nion et al.

(10) Patent No.: US 11,998,120 B2
(45) Date of Patent: Jun. 4, 2024

(54) SUNSHADE FOR OUTDOOR PUBLIC SPACE AND OUTDOOR PUBLIC SPACE HAVING SUCH A SUNSHADE

(71) Applicant: JCDecaux Sa, Neuilly sur Seine (FR)

(72) Inventors: Jean Francois Nion, Los Angeles, CA (US); Pascal Postolle, Itteville (FR); Cedric Davet, Sèvres (FR)

(73) Assignee: JCDecaux SA, Neuilly sur Seine (FR)

( * ) Notice: Subject to any disclaimer, the term of this patent is extended or adjusted under 35 U.S.C. 154(b) by 0 days.

(21) Appl. No.: 17/326,453

(22) Filed: May 21, 2021

(65) Prior Publication Data

US 2022/0125208 A1 Apr. 28, 2022

Related U.S. Application Data

(63) Continuation-in-part of application No. 17/082,841, filed on Oct. 28, 2020.

(51) Int. Cl.

| | |
|---|---|
| ***A47C 7/66*** | (2006.01) |
| ***A47C 3/18*** | (2006.01) |
| ***A47C 7/72*** | (2006.01) |

(52) U.S. Cl.

CPC ..... *A47C 7/66* (2013.01); *A47C 3/18* (2013.01); *A47C 7/725* (2013.01)

(58) Field of Classification Search

CPC ..... E04H 1/1211; E04H 15/58; A45B 2023/0093; A45B 2023/0075; A45B 2023/0012; A45B 2200/1027; A47C 3/18; A47C 7/66

See application file for complete search history.

(56) References Cited

U.S. PATENT DOCUMENTS

| | | | | | |
|---|---|---|---|---|---|
| 398,712 | A * | 2/1889 | Endean | A47C 3/18 | 297/367 R |
| 2,537,787 | A * | 1/1951 | Ramsay | E04H 1/1211 | 135/96 |
| 3,456,980 | A * | 7/1969 | Vandergrift | A47C 7/66 | D25/16 |
| 3,622,201 | A * | 11/1971 | Radig | A01M 31/025 | 135/96 |
| 5,110,184 | A * | 5/1992 | Stein | A47C 7/008 | 297/344.26 |

(Continued)

FOREIGN PATENT DOCUMENTS

| | | | |
|---|---|---|---|
| CN | 2617849 | Y | 5/2004 |
| CN | 204163428 | U | 2/2015 |

(Continued)

OTHER PUBLICATIONS

Extended European Search Report related to Application No. 21204145.3 reported on Mar. 14, 2022.

(Continued)

*Primary Examiner* — Noah Chandler Hawk

(74) *Attorney, Agent, or Firm* — von Briesen & Roper, s.c.

(57) ABSTRACT

A sunshade for an outdoor public space, having a pane made from an at least partially opaque material and a mount adapted to be fixed to the ground and rotatively supporting the pane for rotation about a vertical axis of rotation. The sunshade has a rotation control apparatus adapted to control rotation of the pane.

31 Claims, 21 Drawing Sheets

(56) References Cited

U.S. PATENT DOCUMENTS

| | | | | | |
|---|---|---|---|---|---|
| 5,836,590 | A * | 11/1998 | Mitchell | ..... | A63C 17/1409 188/29 |
| 2001/0040208 | A1 * | 11/2001 | Li | ..... | E04H 12/2238 248/519 |
| 2012/0067388 | A1 | 3/2012 | Zummach | | |

FOREIGN PATENT DOCUMENTS

| | | | | | |
|---|---|---|---|---|---|
| CN | 104783536 | A | 7/2015 | | |
| CN | 210977229 | U | 7/2020 | | |
| DE | 29913252 | U1 | 8/2000 | | |
| DE | 202015008292 | U1 * | 3/2016 | ..... | A47C 11/00 |
| FR | 3042302 | B1 | 11/2017 | | |
| GB | 2437524 | A * | 10/2007 | ..... | E04H 1/1211 |
| GB | 2450674 | A | 1/2009 | | |
| GB | 2513857 | A | 11/2014 | | |

OTHER PUBLICATIONS

GLASSCON; Premium Architectural Building Skins; Brise Soleil & Architectural Solar Shading; pp. 1-21; Glasscon GmbH; Eschborn, Germany.

* cited by examiner

SUNSHADE FOR OUTDOOR PUBLIC SPACE AND OUTDOOR PUBLIC SPACE HAVING SUCH A SUNSHADE

CROSS-REFERENCE TO RELATED APPLICATION

This Application is a continuation in part under 35 U.S.C. 120 of U.S. patent application Ser. No. 17/087,841 filed on Oct. 28, 2020.

FIELD OF THE DISCLOSURE

The present disclosure relates to sunshades for public spaces and to outside public spaces having such sunshades.

More particularly, the present disclosure concerns sunshades useful to protect people from the sun in public spaces such as, for example, public transportation stations. As used in the present, "public transportation station" means a place where public transportation vehicles regularly stop to let users get on and off the public transportation vehicles. Said public transportation vehicles may be, for example, buses, trams, trolleys, trains, above ground metros, car share stations, micro-mobility stations or similar.

BACKGROUND OF THE DISCLOSURE

Public transportation stations, such as bus or trolley pick-up and discharge locations, may be equipped with shelters or the like which protect users from bad weather and from the sun. Many public transportation stations, though, are not equipped with shelters, especially in areas having low rainfall or in locations having limited numbers of users, narrow sidewalks or in other spaces which have physical or technical challenges related to the installation of shelters. In these situations, the users waiting for public transportation may be subjected to exposure from the sun, resulting in adverse impacts to their well-being and health.

Similar situations can be found in other public spaces.

SUMMARY OF THE DISCLOSURE

One purpose of the present disclosure is to improve this situation.

To this end, one object of the present disclosure is a sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said sunshade further includes a rotation control apparatus adapted to control said rotation of said pane.

The persons present in the public space may thus protect themselves from the sun in the shade created by the sunshade. This protection is made particularly efficient as the pane may be rotated and thus orient the sunshade to provide additional shade as desired. Further, the rotation control apparatus avoids uncontrolled rotation of the pane, which might otherwise be inconvenient or dangerous for people present in the public space.

Further embodiments of the above sunshade may have one or several of the following features and/or any combination thereof:

said rotation control apparatus is adapted to brake said rotation of said pane;

said rotation control apparatus is adapted to apply a braking torque comprised between 1 and 15 Nm;

said rotation control apparatus includes a braking device having a braking pad in contact with a circular braking track centered on said axis of rotation;

said braking pad has a braking face in contact with the circular braking track, said braking face having grooves formed therein (the grooves may be disposed otherwise than in radial planes; for instance the grooves may be substantially parallel to the axis of rotation);

said braking pad is elastically biased against said circular braking track;

said rotation control apparatus is adapted to brake permanently said rotation of said pane;

said rotation control apparatus includes:

a user-controlled immobilization device movable between an immobilization position in which the user-controlled immobilization device is adapted to immobilize said pane and a rotation position in which the user-controlled immobilization device enables rotation of said pane around said axis of rotation, and an actuator adapted to move the user-controlled immobilization device between said immobilization position and said rotation position, said actuator being adapted to be controlled by a user;

said user-controlled immobilization device is elastically biased toward the immobilization position;

said user-controlled immobilization device has a braking pad and a circular braking track centered on said axis of rotation, said braking pad being in contact with said circular braking track when the user-controlled immobilization device is in the immobilization position;

said user-controlled immobilization device is adapted to apply a braking torque higher than 1 Nm when the user-controlled immobilization device is in the immobilization position;

said pane has a seat and said actuator is accessible to a user under said seat;

said rotation control apparatus includes a seat-activated immobilization device which is movable between an immobilization position in which the seat-activated immobilization device is adapted to immobilize said pane and a rotation position in which the seat-activated immobilization device enables rotation of said pane around said axis of rotation, said sunshade having a seat for a user, said sunshade including a movable actuation part which is spring biased upwardly toward a rest position, said movable actuation part being adapted to move downward to an actuation position under a weight of the user when said user is seated on said seat, and said movable actuation part is connected to the seat-activated immobilization device so that the movable actuation part puts the seat-activated immobilization device:

in the rotation position when said movable actuation part is in the rest position, and in the immobilization position when said movable actuation part is in the actuation position;

said seat-activated immobilization device includes a first immobilization member which is rigid with said movable actuation part and a second immobilization member which is rigid with said mount, said first immobilization member and said second immobilization member being maintained spaced apart from one another by a compression spring when the movable actuation part is in the rest position, said first immobilization member and said second immobilization member being in mutual engagement and the compression spring is compressed, when the movable actuation part is in the actuation position;

said first immobilization member and said second immobilization member have mutually facing teeth adapted to engage mutually when the seat-activated immobilization device is in the immobilization position;

said pane has a rest angular position and said rotation control apparatus includes a return spring-biasing the pane in rotation around said axis of rotation toward said rest angular position;

said rotation control apparatus is adapted to limit a rotation amplitude of the pane around the rotation axis;

said rotation control apparatus includes an indexing device adapted to index the pane in at least one predetermined angular position;

said indexing device has a circular track centered on the axis of rotation and at least one pusher elastically biased against the circular track, said circular track having at least one recess adapted to receive the pusher when the pusher is angularly in register with the recess, said circular track and said at least one pusher being mounted so that when the pane is rotated, said at least one pusher and said circular track have a relative movement of rotation around the rotation axis;

said indexing device is adapted to maintain the pane in said at least one predetermined angular position as long as the pane is not submitted to a minimum torque in rotation around the axis of rotation, said minimum torque being comprised between 1 and 15 Nm.

Besides, another object of the present disclosure is a sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface;

a post adapted to be fixed to the bottom surface and extending along said rotation axis, said pane being able to rotate around said post while said post is fixed.

Further embodiments of the above sunshade may have one or several of the following features and/or any combination thereof:

said post supports a signage;

said post supports a lighting.

said lighting is electrically fed from a source of energy and said pane includes electrical equipment which is fed from said source of energy.

Still another object of the present disclosure is a sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said mount includes a gliding bearing enabling rotation of said pane.

A further object of the present disclosure is a sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said pane is of substantially elongate shape, with a height extending longitudinally, substantially parallel to the axis of rotation, between a lower end and an upper end, and wherein said pane has a width and a thickness which are perpendicular to the axis of rotation, the greatest thickness being smaller than the greatest width.

Further embodiments of the above sunshade may have one or several of the following features and/or any combination thereof:

said width is comprised between 32 cm and 140 cm perpendicular to said axis of rotation;

said width is comprised between 50 and 70 cm;

said upper end of said pane is at a height comprised between 130 cm and 300 cm above the bottom surface of the outdoor public space;

said upper end of said pane is at a height comprised between 180 cm and 250 cm above the bottom surface of the outdoor public space;

said outdoor public space includes a public transportation station and said sunshade is installed at said public transportation station;

said sunshade further has an inclined wall which extends upwards from substantially said upper end of said pane;

said inclined wall has an upper face equipped with at least one photovoltaic panel;

said pane has a first face and a second face opposite to said first face, said second face having equipment usable by users of the sunshade;

said sunshade has an inclined wall which extends upwards from said second face of the pane, substantially at said upper end of said pane;

said equipment includes a seat adapted to support a user sitting on said seat;

the first face of the pane has an additional seat adapted to support a user sitting on said additional seat;

said equipment includes at least one electrical device;

said at least one electrical device is chosen in the group comprising: a display, an electrical charger for mobile electronic devices;

said sunshade further includes at least one photovoltaic panel, at least one battery and an electrical system electrically supplied from said at least one photovoltaic panel through said at least one battery;

said electrical system includes lighting;

said electrical system includes a motorized orientation apparatus adapted to orient the sunshade to face the sun;

said electrical system includes a display;

said display is a digital display and said electrical system further includes a processing unit and a communication interface, said processing unit controlling the communication interface and the display, said processing unit being adapted to communicate, via the communication interface, with a remote source of information to retrieve information for displaying said information on the display;

said sunshade is installed at a public transportation station and said information includes timing of arrival and/or departure of public transportation vehicles at said public transportation station;

the sunshade further has a wall which extends from substantially said upper end of said pane and which is adapted to protect a user from weather, said wall being either substantially horizontal or inclined;

the sunshade further includes lateral walls extending from said pane under said wall to protect a user from weather;

the pane is opaque;

said upper end of said pane is free.

Another object of the present disclosure is an outdoor public space having a sunshade as defined above, said mount being fixed to the bottom surface and said axis of rotation extending substantially vertically.

In embodiments of the above outside public space, one may further use one or several of the following features and any combination thereof:

said outdoor public space includes a public transportation station;

the outdoor public space further includes a bench fixed to the ground in the vicinity of the sunshade;

said bench is shaped substantially as an arc of circle centered on said axis of rotation.

BRIEF DESCRIPTION OF THE DRAWINGS

Other features and advantages will appear from the following description of several embodiments, given by way of non-limiting examples, with reference to the drawings.

In the drawings.

MORE DETAILED DESCRIPTION

In the various drawings, the same references designate identical or similar elements.

Figure 1:
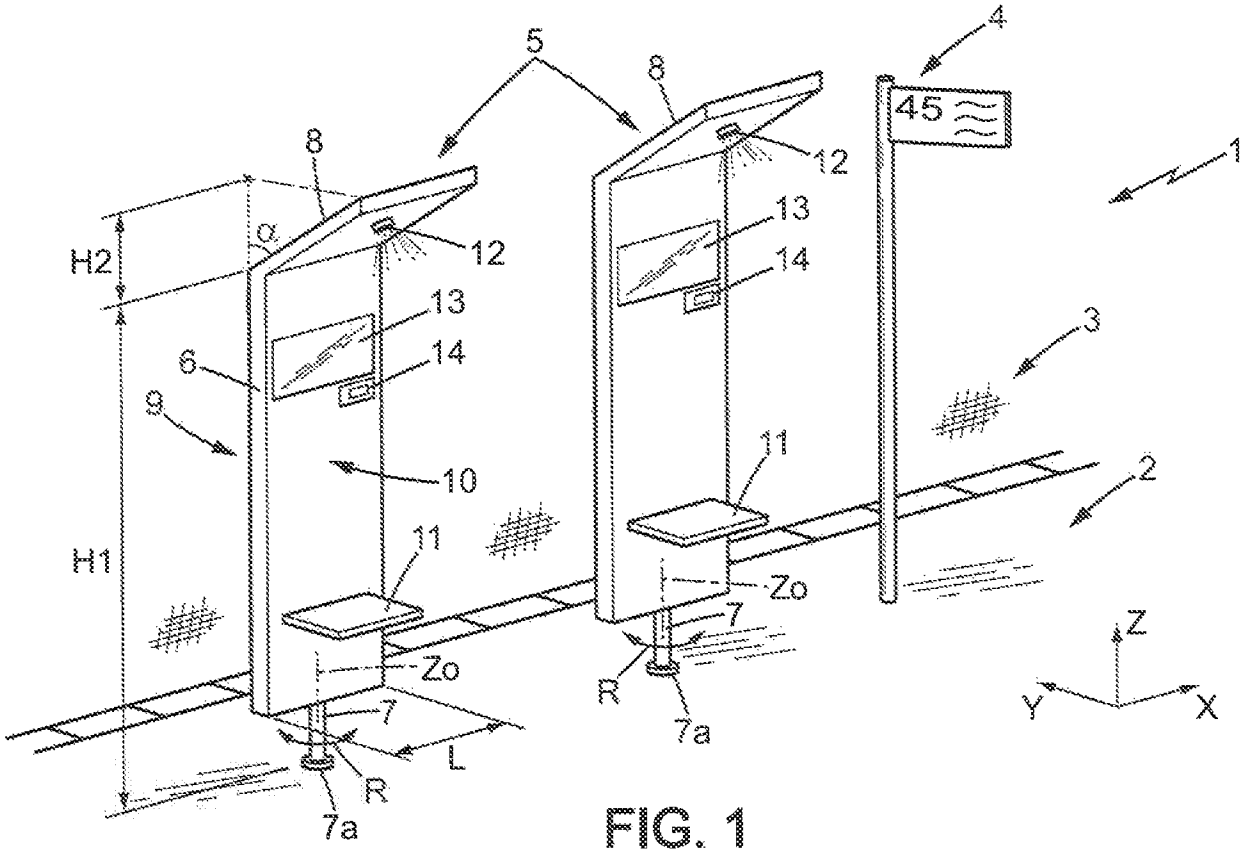
FIG. 1 shows an example of outdoor public space having sunshades according to a first embodiment.

FIG. 1 shows an outdoor public space 1, situated in a public place, for instance being part of a sidewalk 2 beside street 3.

Outdoor public space 1 may be or include for instance a public transportation station as defined above, for instance a bus station.

The public transportation station may include for instance a signage 4 marking the place of the station for public transportation vehicles to stop.

Outdoor public space 1 includes one or more sunshades 5, for shading users who are waiting for public transportation vehicles at the public transportation station.

Figure 2:
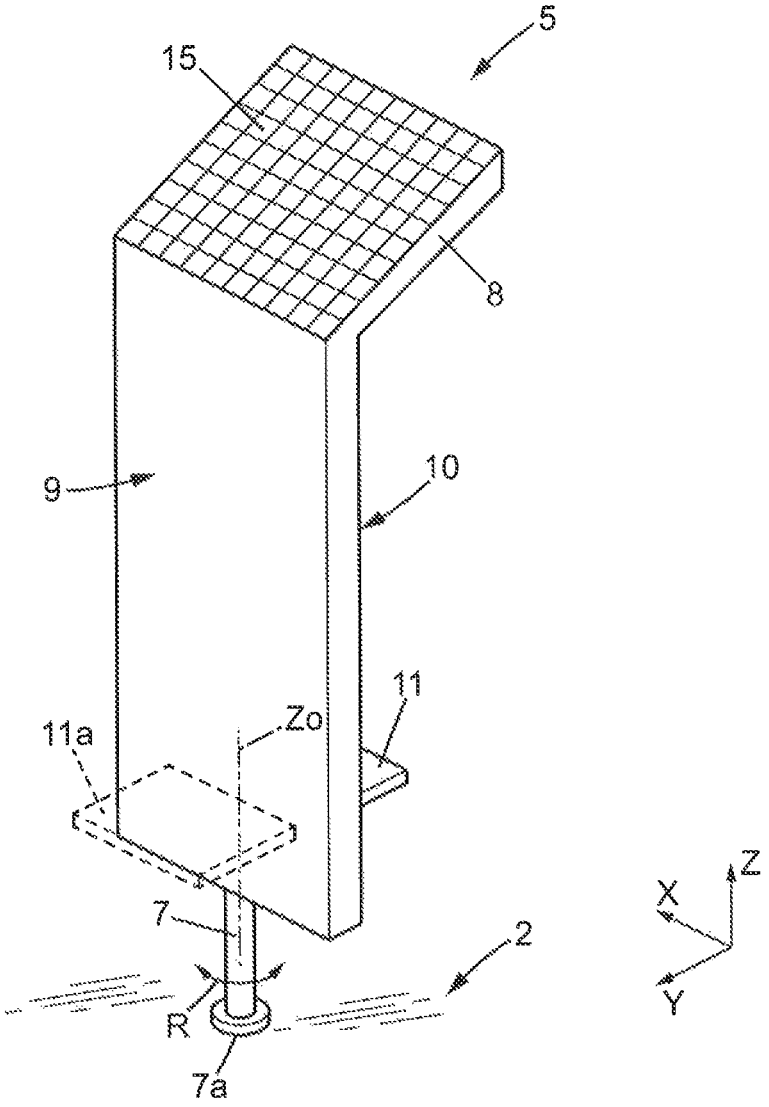
FIG. 2 is perspective view of one of the sunshades of the outdoor public space of FIG. 1.

Each sunshade 5, as illustrated by FIGS. 1 and 2, includes a pane 6 which blocks sunlight at least partially. Pane 6 may be opaque. For instance, pane 6 may be made from an opaque solid material or from an opaque structured material.

In a variant, pane 6 may let through part of the sunlight, for instance less than 50% of the incident light intensity. In this variant, pane 6 may be made from a structured opaque material having holes which let through part of the sunlight, or from a transparent colored material or from a translucent material.

Pane 6 may be rigidly mounted on a foot 7 which itself is pivotally supported by a pivotal mount 7*a* fixed to the ground, so that said pane 6 and foot 7 are orientable by rotation about an axis of rotation Z0 which is substantially vertical. In a variant, pane 6 could be orientable and foot 7 could be fixed.

More generally speaking, pane 6 is mounted (directly or indirectly) on a pivotal mount 7*a* which is fixed (directly or indirectly) to the ground and which is pivotally supporting said pane 6 so that said pane is orientable by rotation about substantially vertical axis of rotation Z0.

Pivotal mount 7*a* may be installed in the ground, for instance in the sidewalk 2, as shown.

Alternatively, pivotal mount 7*a* may be adapted to mount pane 6 on a pole which is fixed to the ground, such as a pole from signage 4 or from a lighting or from a pedestrian light or from a bus shelter, etc. Pivotal mount 7*a* may simply be part of the pole, on which pane 6 is adapted to pivot around axis of rotation Z0.

When pane 6 is mounted on the pole, such pole may guide pane 6 in rotation on all the height of pane 6. For instance, the pole could be fixed and pane 6 could include a tubular coupling fitted on the pole, thus permitting rotation. In that example, the fixed pole constitutes said pivotal mount.

In a variant, pane 6 could be mounted to the pole through bearings mounted on the pole at one or several specific heights to guide pane 6 in rotation.

In one example, pane 6 may be freely rotatable on pivotal mount 7*a*.

In another example, pivotal mount 7*a* may include a brake, to brake rotation movements of pane 6 in case of wind for instance and/or to avoid the fall of a user leaning on pane 6.

In still another example pivotal mount 7*a* may include a brake or lock, to stop rotation movements of pane 6 as long as an actuation member (not shown) is not actuated by a user. Such actuation member might be a pedal or a handle actuatable by a user.

Pivotal mount 7*a* may also include a mechanism to replace the pane automatically to a predetermined position, for instance a certain time after orientation by a user.

In still another example pivotal mount 7*a* may include a motorized mechanism as will be explained below with regard to the second embodiment.

Pane 6 is of substantially flat and elongate shape, extending longitudinally, substantially parallel to a vertical axis Z, between a lower end connected to the pivotal mount and an upper end.

The upper end of pane 6 is a free end in the example disclosed in the drawings.

Said upper end of said pane may be at a height H1 comprised between 130 cm and 300 cm above the ground. The lower values of this range are usable especially when the pane is equipped with a seat as will be explained below. In one example of preferred embodiment, said height H1 may be comprised between 180 cm and 250 cm. For instance, height H1 may be of about 210 cm.

The lower end of pane 6 may be at a height of a few tens of centimeters above the ground, for instance 20 to 50 cm, which helps limit the obstruction by sunshade 1 of the sidewalk.

Pane 6 also extends laterally on certain width L parallel to a horizontal axis X. Width L may be comprised between 32 cm and 140 cm, in particular between 50 and 70 cm. For instance, width L may be of about 60 cm.

Rotation axis Z0 may be substantially in the middle of width L.

Pane 6 has also a certain thickness parallel to a second horizontal axis Y perpendicular to axis H. Such thickness may be constant on all the extent of pane 6 (flat pane 6) or not. Pane 6 might have for instance a profiled shape similar to an airplane wing. Typical values for the thickness of pane 6 may be of a few centimeters, for instance 1 to 10 cm. Generally, pane 6 is shaped so that, when considering a horizontal cross-section thereof, its greatest thickness within this horizontal cross-section is smaller than its greatest width.

Sunshade 1 may further have an inclined wall 8 which extends upwards from said upper end of pane 6.

Inclined wall 8 may extend vertically on a height H2 over the upper end of pane 6. H2 may be for instance comprised between 30 and 60 cm. In one example, H2 may be about 45 cm.

Inclined wall 8 may be substantially flat and may form an angle $\alpha$ of for instance 30 to 60 degrees with vertical plane XZ. In one example, angle $\alpha$ may be of about 45 degrees.

Inclined wall 8 has an upper face which, in one example, may be equipped with at least one photovoltaic panel 15.

Pane 6 has a first face 9, adapted to be oriented toward the sun, and a second face 10 opposite to said first face. Said inclined wall 8 extends from said second face.

In one example, first face 9 of pane 6 may bear for instance advertisement or other information, or decoration, or branding, or city public service announcement or additional photovoltaic panel(s) (not shown).

Second face 10 of the pane may have equipment usable by users of the sunshade.

Such equipment may include a seat 11 adapted to support a user sitting on said seat. Seat 11 may be mounted to pane 6, or for instance to foot 7. Seat 11 may be fixed in use position or may be foldable between the use position as shown and a vertical, retracted position (not shown).

In a variant, first face 9 of pane 6 may have an additional seat 11*a* (FIG. 2) adapted to support a user sitting on said additional seat. Additional seat 11*a* may be similar to seat 11 as described above. Seat 11*a* may be used by users willing to seat in the sun, for instance in winter.

In another example, the above-mentioned equipment of the second face 10 of pane 6 may also include at least one electrical device (in addition or alternatively to seat 11).

In one example, said at least one electrical device may be chosen in the group comprising: a display 13; an electrical charger 14 for mobile electronic devices; an emergency call system (for instance, having a call button, a microphone and a loudspeaker).

The sunshade 5 may also include a lighting 12, for instance in the lower face of inclined wall 8.

The above display 14, or an additional display, could also be located in the lower face of inclined wall 8.

Figure 3:
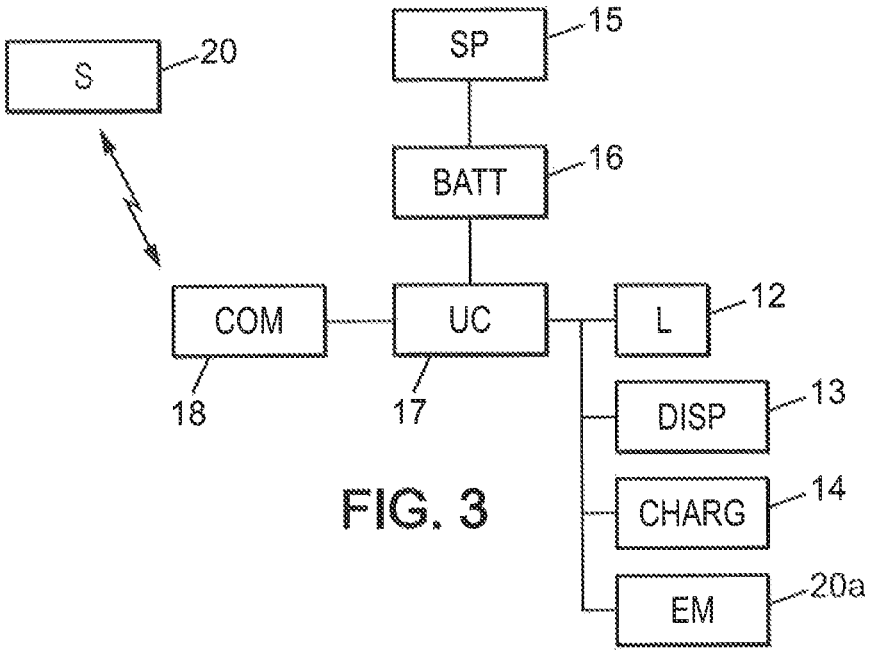
FIG. 3 is a block diagram showing some of the components in the sunshade of FIG. 2.

As illustrated in FIG. 3, sunshade 5 may include at least one battery 16 (BATT) supplied by photovoltaic panel(s) 15 (SP), at least one battery and an electrical system which is electrically supplied from said at least one photovoltaic panel 15 through said at least one battery 16.

Said electrical system may include an electronic processing unit 17 (UC) such as a microcontroller or similar unit, which controls electrical devices such as, for example:

- said lighting 12 (L), which is controlled to produce light only at night; and/or
- said display 13 (DISP), for instance a digital display; and/or
- said charger 14 (CHARG); and/or
- a communication interface 18 (COM), able to communicate, wirelessly or not, with a remote source of information 20 (S) such as at least one server; and/or
- said emergency call system 20*a* (EM) including for instance a call button, a microphone, a loudspeaker and a communication interface adapted to communicate with a distant security center.

The electrical system could also be connected to an external power source (not shown) such as a public electricity network.

Processing unit 17 may be adapted to communicate, via communication interface 18, with remote source of information 20 to retrieve information, and processing unit 17 controls display 13 to display said information.

Said information may include:

- timing of arrival and/or departure of public transportation vehicles at the public transportation station; and/or
- general information; and/or
- advertisement.

Figure 4:
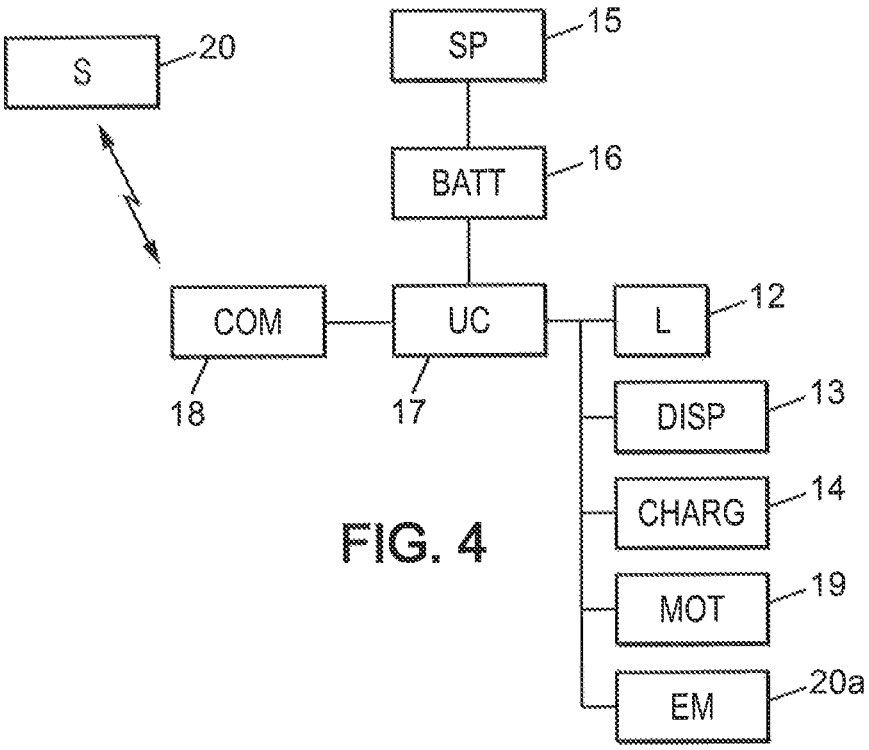
FIG. 4 is a block diagram similar to FIG. 3, in a second embodiment.

In the second embodiment, illustrated by FIG. 4, the disclosure above regarding the first embodiment applies, and said electrical system may further include a motorized orientation apparatus 19 (MOT) which equips for instance pivotal mount 7*a* and which is controlled by processing unit 17 to orient the sunshade 5 so that first face 9 of pane 6 always faces the sun during the day. Orientation of sunshade 5 may be controlled by processing unit 17 for instance based on programmed orientations as a function of time.

Figure 5:
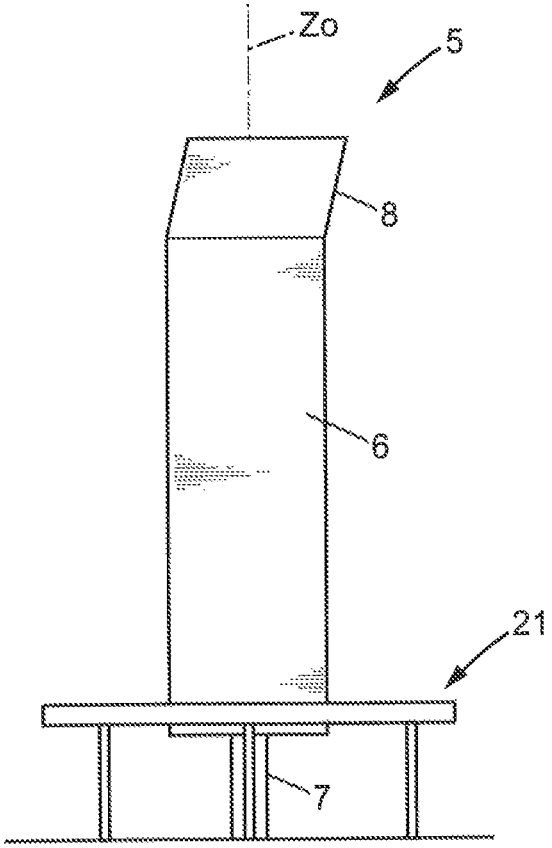
FIGS. 5 and 6 are respectively a schematic side view and a schematic top view of a third embodiment.
Figure 6:
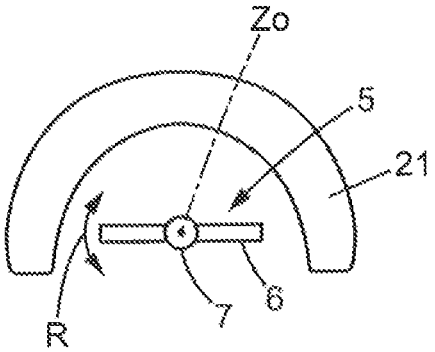

In the third embodiment, illustrated by FIGS. 5-6, sunshade 5 may be combined with a bench 21 which is fixed to the ground, for users to sit in the shade of sunshade 5. Bench 21 may be shaped substantially as an arc of circle centered on said axis of rotation Z0 and extending for instance on 90 to 270 degrees around axis Z0. Otherwise, all description of the first and second embodiments is applicable to the third embodiment.

Figure 7:
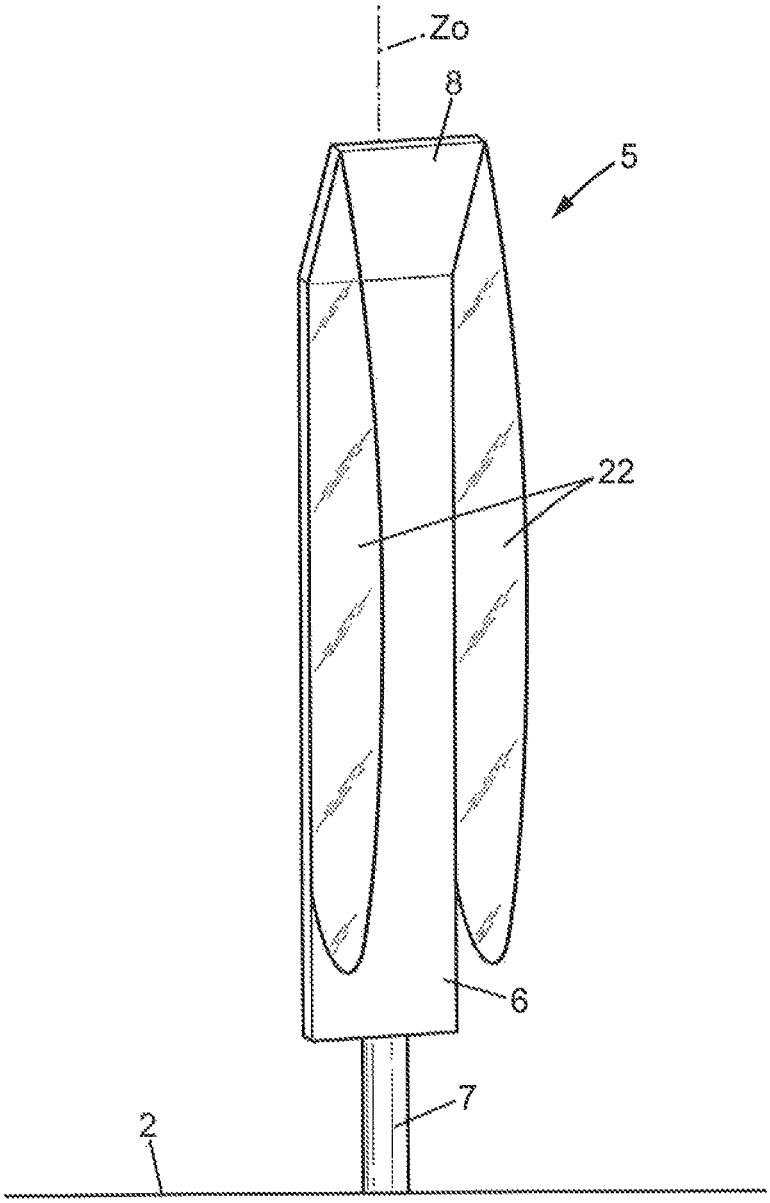
FIG. 7 is a schematic perspective view of a fourth embodiment.

In the fourth embodiment, illustrated by FIG. 7, inclined wall 8 is combined with lateral walls 22 which extend downward from inclined wall 8 and rearward of pane 6. Inclined wall 8, in combination with lateral walls 22, protects a user situated under said wall 8 against bad weather conditions such as rain, wind, snow or hail. Inclined wall 8 may be replaced by a substantially horizontal wall. Otherwise, all description of the first, second and third embodiments is applicable to the fourth embodiment.

In the fifth to eighth embodiments, described below, the sunshade 5 further includes a rotation control apparatus adapted to control rotation of pane 6.

The rotation control apparatus avoids uncontrolled rotation of the pane, which might otherwise be inconvenient or dangerous for people present in the public space.

The fifth to eighth embodiments will be described in detail below only for the features that are different from those already described above. All features described above are applicable to the fifth to eighth embodiments as long as they are not in contradiction with the specific features described below.

Figure 8:
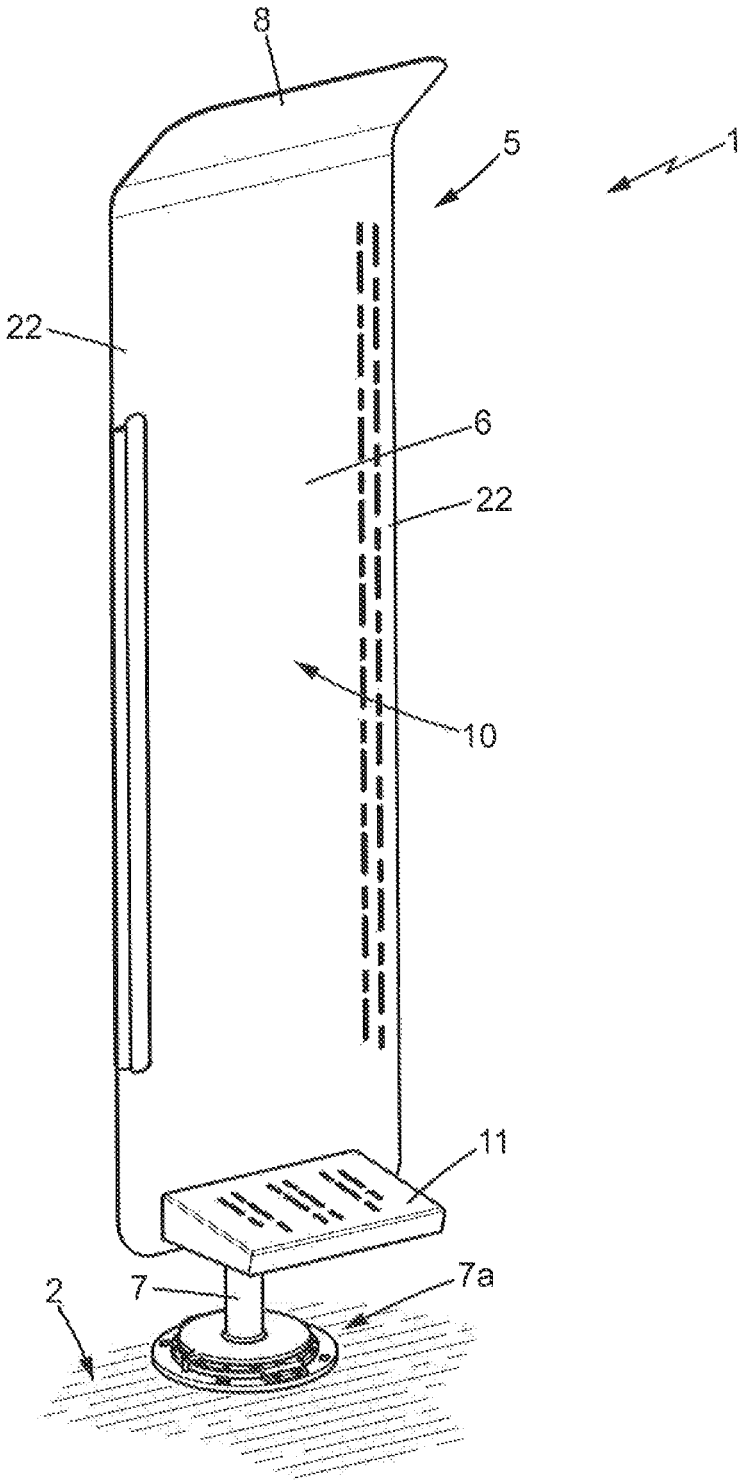
FIG. 8 is a schematic perspective view of a fifth embodiment.
Figure 9:
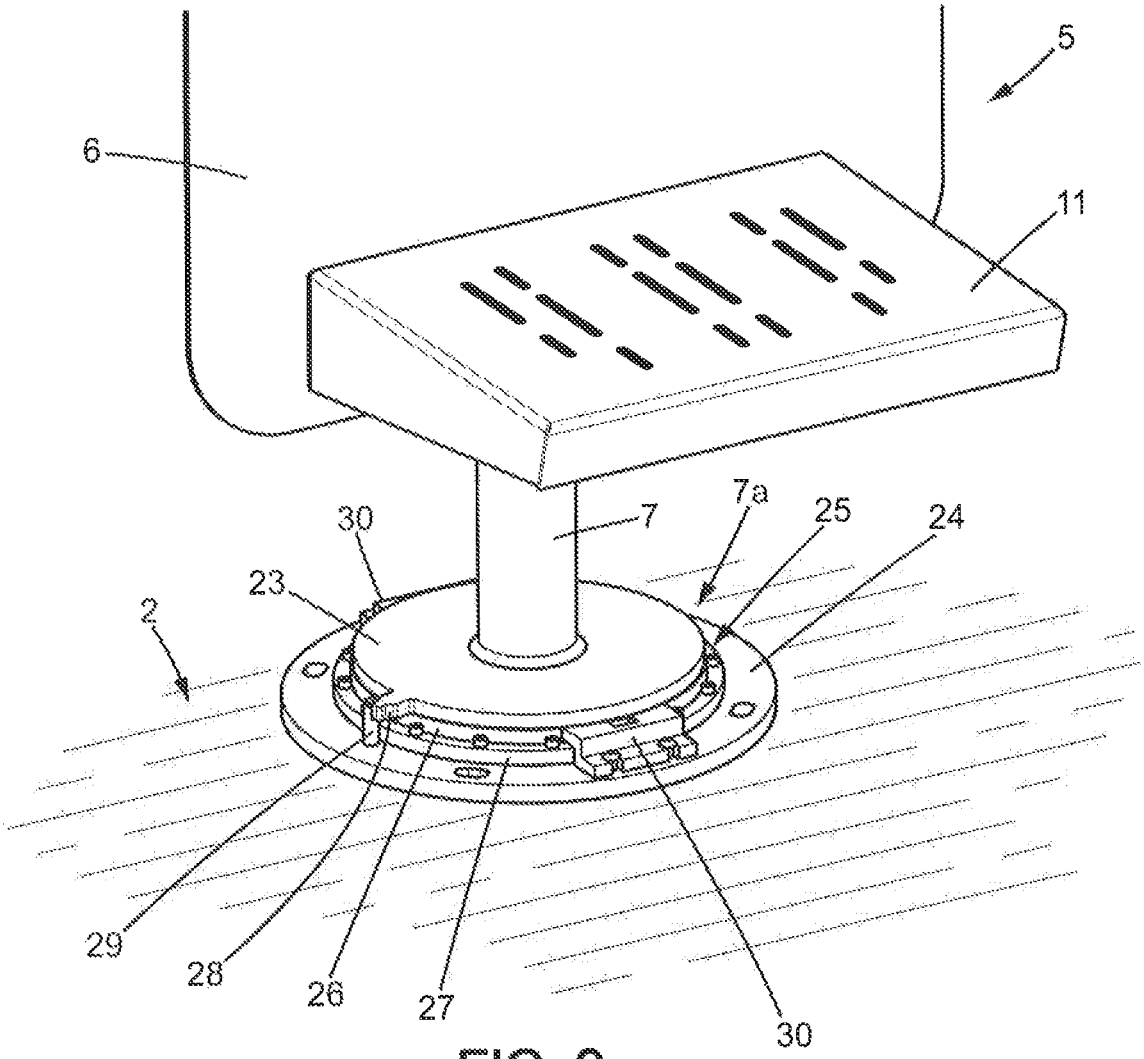
FIG. 9 shows a detail of the sunshade of FIG. 8.
Figure 10:
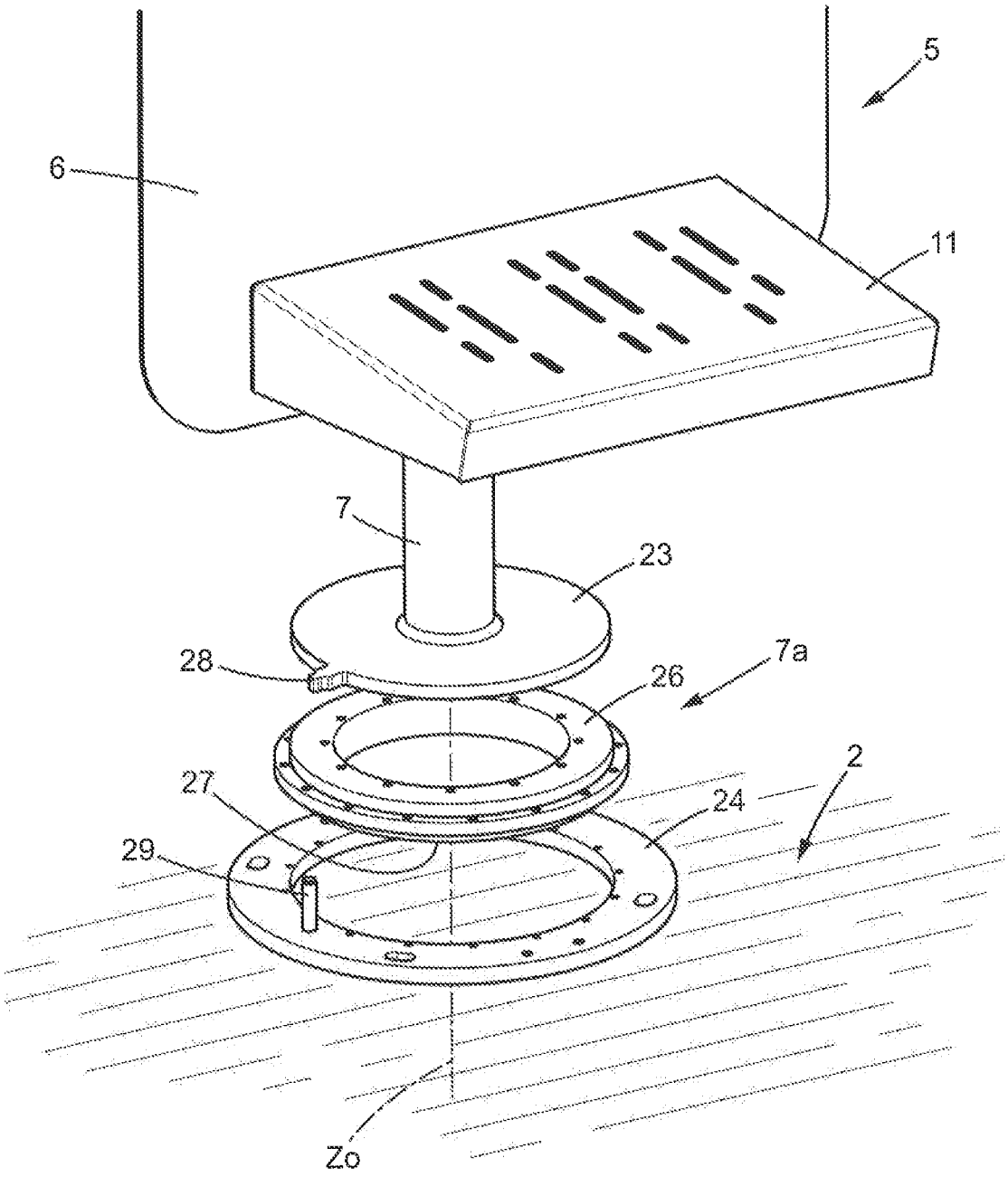
FIG. 10 is an exploded view corresponding to FIG. 9.

In the fifth embodiment, shown in FIGS. 8-10, said rotation control apparatus is adapted to limit a rotation amplitude of the pane 6 around the rotation axis Z0. The rotation amplitude may be here limited to about 340 degrees, but of course the rotation amplitude could be limited to a different value.

More specifically, the rotation amplitude can be limited by abutment of at least one stop member 28 which is unitary with pane 6, against at least one fixed counter-stop member 29.

In the example shown in FIGS. 8-10, the sunshade 5 has one stop member 28 and one counter-stop member 29.

In the fifth embodiment, pivotal mount 7*a* may include a basis 23, a seat 24 and a bearing 25 interposed between basis 23 and seat 24. Basis 23 may be superposed on bearing 25 which is superposed on seat 24. Basis 23 may be unitary with foot 7 and pane 6, while seat 24 may be fixed to the ground, e.g. to the sidewalk 2.

Stop member 28 may be part of basis 23 and counter-stop member 29 may be part of seat 24. In the example shown in FIGS. 8-11, stop member 28 may be in the form of a protrusion extending externally from basis 23 (e.g. radially with respect to the axis of rotation Z0) and counter-stop member 29 may protrude upward from seat 24, for instance in the form of a stem or similar.

Basis 23 may be disk-shaped and centered on the axis of rotation Z0.

Seat 24 may be annular-shaped and centered on the axis of rotation Z0.

Bearing 25 may be a flat bearing and may be annular-shaped and centered on the axis of rotation Z0. Bearing 25 may have a first bearing member 26 fixed to basis 23, a second bearing member 27 fixed to seat 24. The first bearing member 26 is able to rotate on the second bearing member around the axis of rotation Z0. For instance, a gliding material having a low friction coefficient may be interposed between the first bearing member 26 and the second bearing member 17. The gliding material may be for instance "Iglidur"®.

The gliding bearing 25 is especially well adapted to an outdoor use.

First bearing member 26 may be maintained on second bearing member 27 and seat 24 by jaws 30 which are fixed to seat 24.

In the sixth embodiment, shown in FIGS. 11-18, said rotation control apparatus may comprise:

- a braking system, e.g. a permanent braking system;
- a rotation limitation system;
- a seat-activated immobilization device which is activated when a user is seated on the seat of the sunshade;
- a user-controlled immobilization device which is normally maintained activated and can be deactivated by an actuator controlled by a user;
- a return system adapted to return the pane 6 in a predetermined rest position.

Each of these five features could be used alone or in combination with one or more of the other five above features.

Braking System

The braking system is adapted to apply a braking torque on pane 6 comprised between 1 and 15 Nm. In other words, it is necessary to apply a torque of more than said braking torque on pane 6 to rotate it around the axis of rotation Z0.

The braking system may include at least one braking device 33, 33*a* (see FIGS. 15-16) having a braking pad 37 in contact with a circular braking track centered on said axis of rotation Z0. The braking may be formed in elastomer.

The circular braking track may be part of the outside surface of a post 58 which is secured to a pedestal 31 fixed to the ground (e.g. sidewalk 2). Post 58 and pedestal 31 belong to pivotal mount 7*a*. The foot 7 of the sunshade may include a vertical external tubular member which is centered on the axis of rotation Z0 and which is fit on post 58. The braking pad 37 of the or each braking device 33, 33*a* may go through a respective radial slot 60 (FIG. 17) formed in foot 7.

The braking pad 37 has a braking face 38 in contact with the circular braking track. Said braking face 38 may have grooves 39 formed therein. The grooves 39 may be disposed otherwise than in radial planes; for instance the grooves 39 may be substantially parallel to the axis of rotation Z0.

Braking pad 37 may be elastically biased against said circular braking track and/or may be adjustable in position relative to said circular braking track.

In the particular example of FIGS. 11-18, the braking system may be fixed to the underside 32 of pane 6.

The braking system may include two braking devices 33, 33*a* disposed on substantially opposite sides of post 58. For instance, the braking pads 37 of both braking devices 33, 33*a* may act on post 58 in directions which together form an angle comprised between 120 and 180 degrees.

The first braking device 33 may have its braking pad elastically biased by a spring 42 against the circular braking track (post 58) while the second braking device 33*a* may have its braking pad immobilized with regard to pane 6. In the embodiment as shown on FIGS. 15-16, the second braking device may have its braking pad 37 adjustable toward the circular braking track or away from the circular braking track, for instance by a screw 42*a*, to adjust the braking mechanism upon initial installation or upon maintenance operations.

Each braking device 33, 33*a* may include a support plate 35 fixed to the underside 32 of the pane and a superposed, slidable plate 36 which is slidably mounted on the support plate 35 in a radial direction relative to the axis of rotation Z0. Support plate 35 and slidable plate 36 may be for instance metal plates. Slidable plate 36 may for instance have two parallel grooves 40 and support plate 35 may have two tabs 41 inserted in each groove 40, thus enabling the sliding movement and retaining sliding plate 36 on support plate 35.

The support plate 35 and the sliding plate 36 of the first braking device 33 may respectively have tabs 43, 44 between which spring 42 is mounted.

The support plate 35 and the sliding plate 36 of the second braking device 33*a* may also respectively have similar tabs 43*a*, 44*a*. The screw 42*a* traverses tab 43*a* and the distal end of screw 42*a* abuts tab 44*a*. Nuts 42*b*, 42*c* may be screwed on screw 42*a* respectively on both sides of tab 43*a*.

Rotation Limitation System

The rotation limitation system is adapted to limit a rotation amplitude of the pane 6 around the rotation axis Z0. The rotation amplitude may be here limited to about 340 degrees, but of course the rotation amplitude could be limited to a different value.

More specifically, the rotation amplitude can be limited by abutment of at least one stop member 65*b* which is unitary with pane 6, against at least one fixed counter-stop member 65.

In the example shown in FIGS. 11-18, the sunshade 5 has one stop member 65*b* and one counter-stop member 65.

Figure 14:
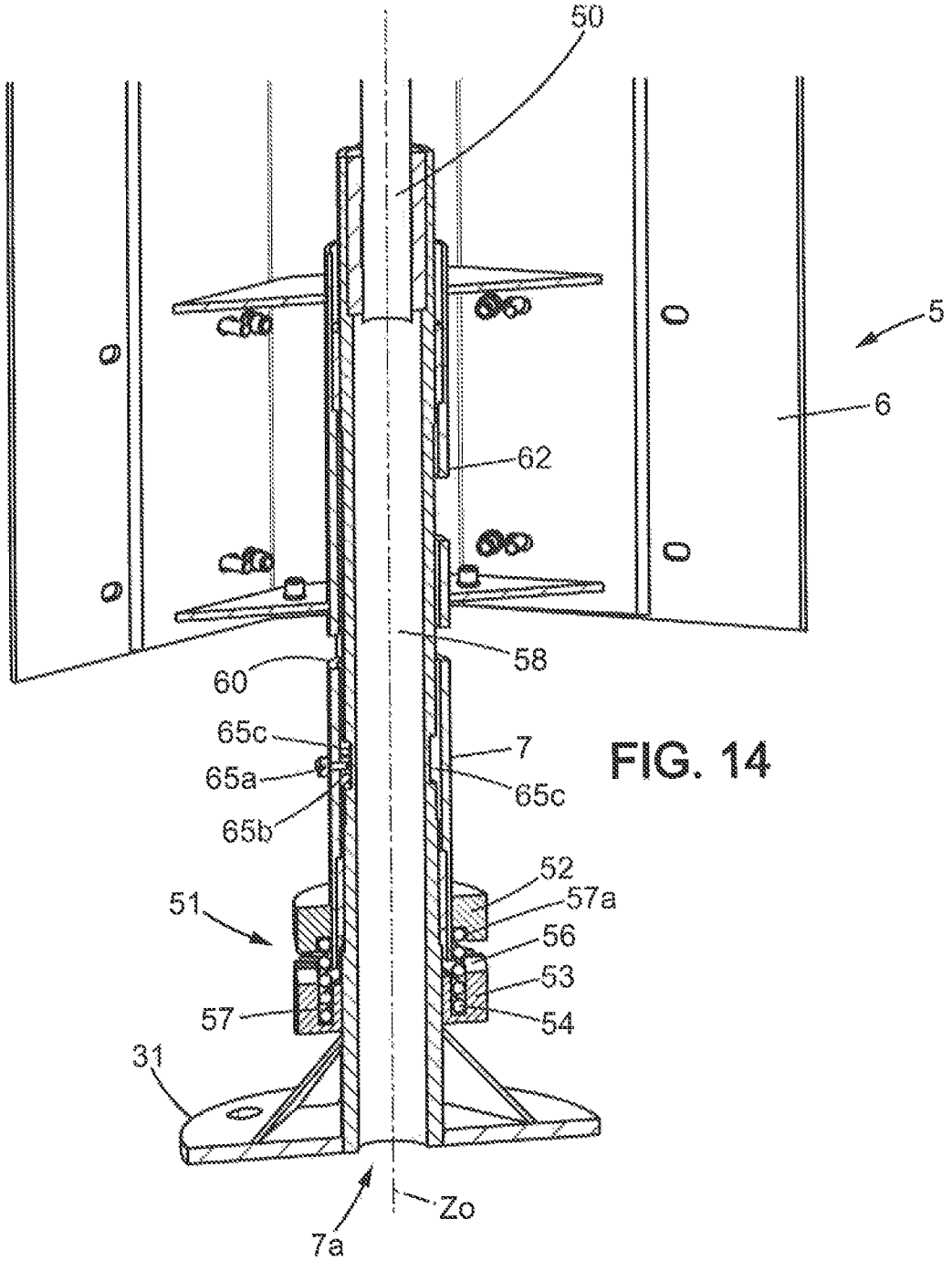
FIG. 14 is a vertical section view of the sunshade of FIGS. 11-12.
Figure 18:
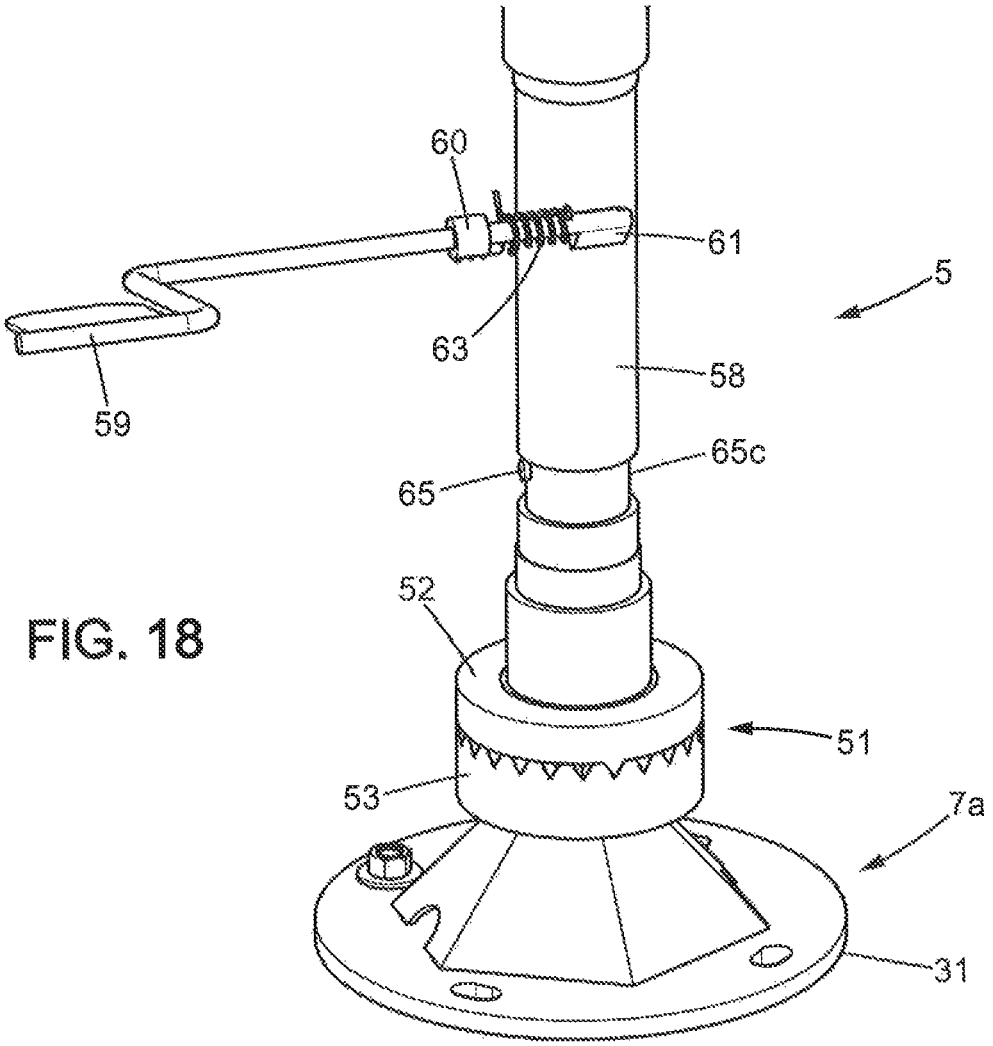
FIG. 18 is a view similar to FIG. 17, without the external tubular member of the foot of the sunshade.

Stop member 65*b* may protrude inside foot 7, into a groove 65*c* of post 58 (see in particular FIGS. 14 and 18). For instance stop member 65*b* may include a nut screwed on a screw 65*a* which goes through the outside peripheral wall of foot 7. Counter-stop member 65 may include a screw or pin fixed to post 58 and protruding inside grove 65*c*.

Seat-Activated Immobilization Device

The seat-activated immobilization device 51 (best seen on FIGS. 12-14) is activated when a user is seated on the seat of the sunshade. The seat-activated immobilization device 51 is movable between an immobilization position in which the immobilization device 51 is adapted to immobilize said pane 6 (FIG. 12) and a rotation position in which the immobilization device 51 enables rotation of said pane 6 around said axis of rotation Z0 (FIGS. 13-14).

Figure 13:
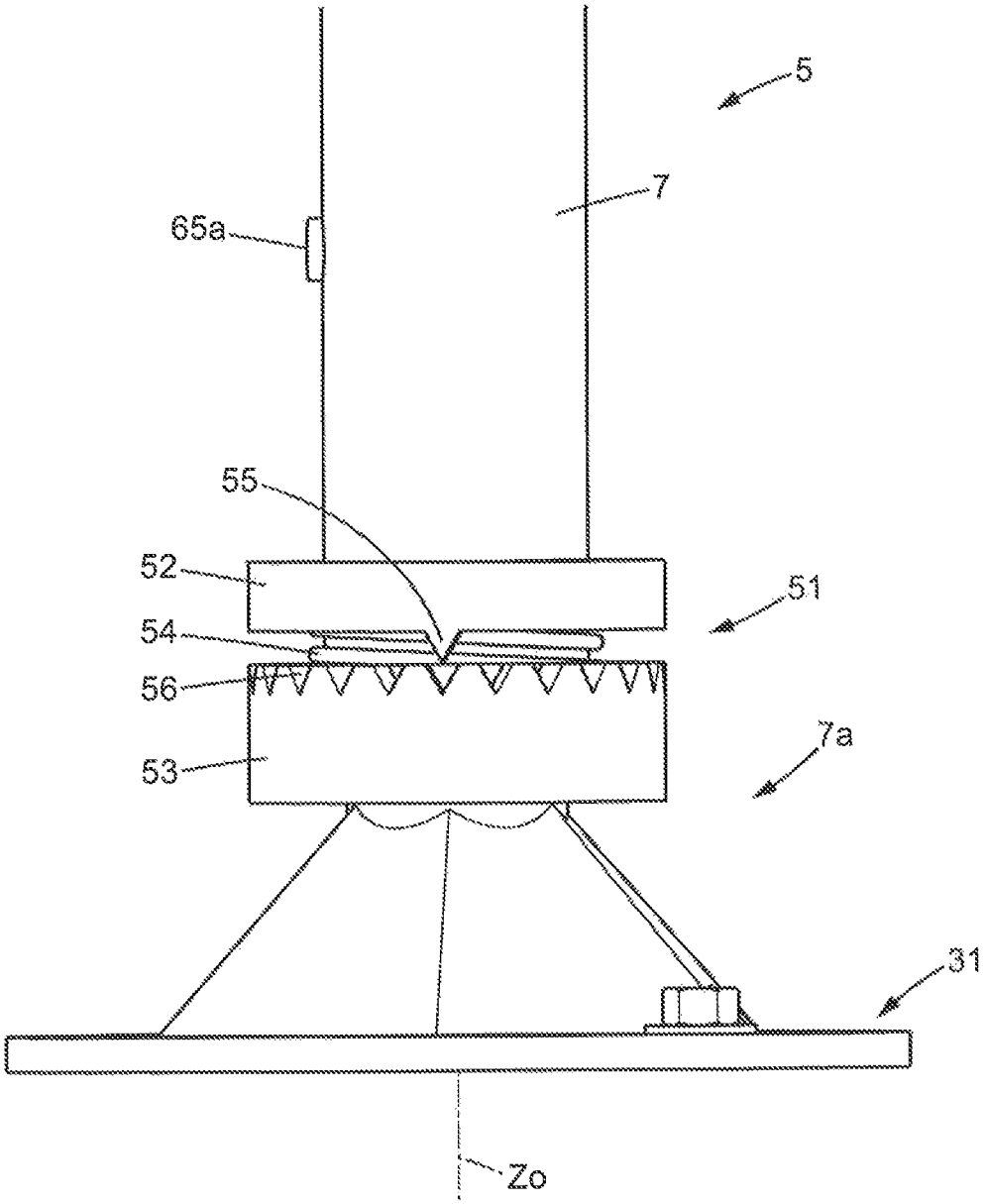
FIG. 13 shows an enlarged view of an immobilization device belonging to the sunshade of FIGS. 11-12, in the rotation position.

The foot 7 is slidably mounted on the post 58 and is elastically biased upwardly by a spring 54 toward a rest position (FIGS. 13-14).

Figure 12:
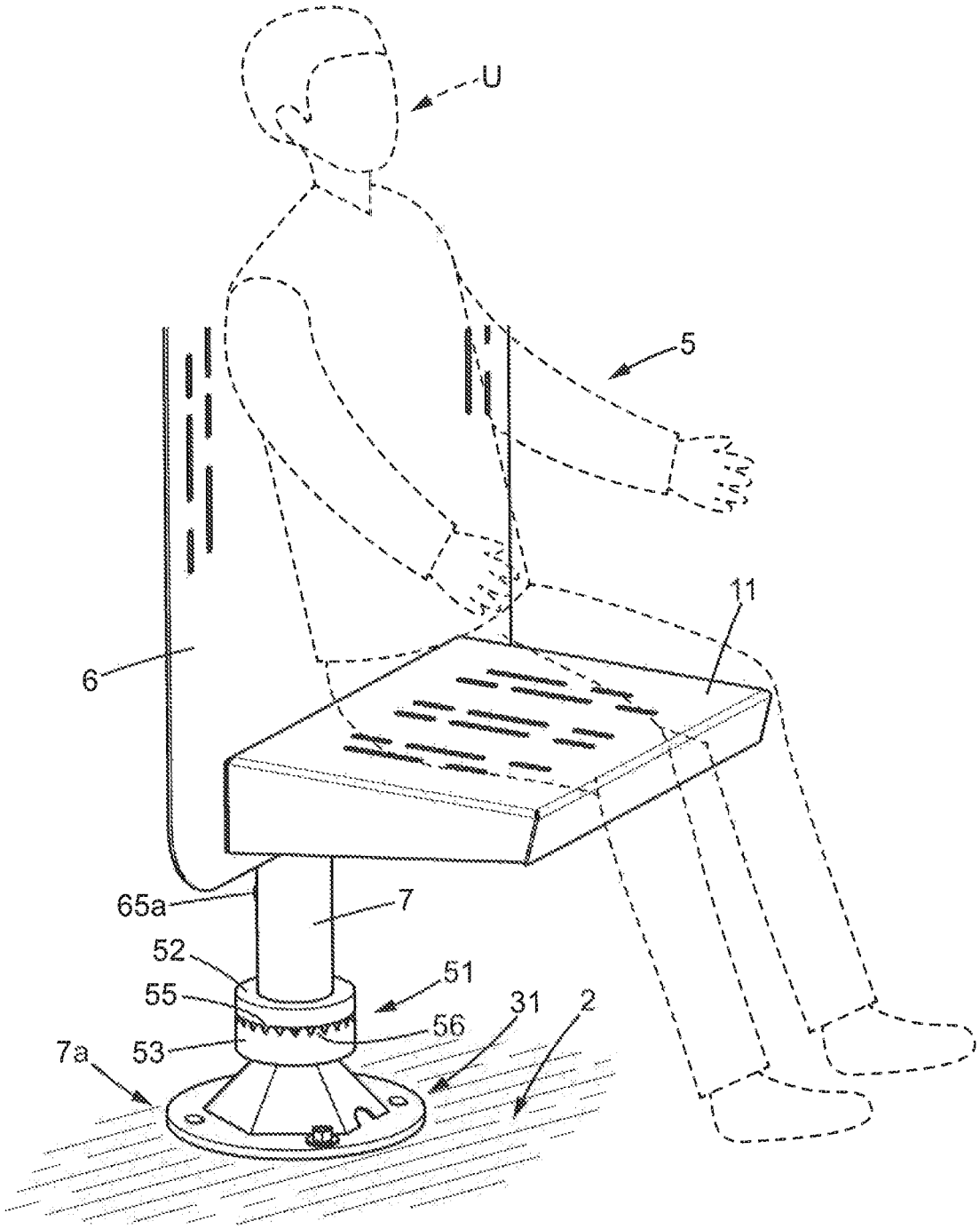
FIG. 12 shows a detail of the sunshade of FIG. 11.

The foot 7 is adapted to move downward to an actuation position under the weight of a user U when said user U is seated on seat 11 (FIG. 12), and said foot 7 is connected to the seat-activated immobilization device 51 so that the foot 7 puts the seat-activated immobilization device 51:

- in the rotation position when the foot 7 is in the rest position (FIGS. 13-14);
- and in the immobilization position when said foot 7 is in the actuation position (FIG. 12).

The foot 7 thus constitutes a vertically movable actuation part which is able to actuate the seat-activated immobilization device 51.

The seat-activated immobilization device 51 may include a first immobilization member 52 which is rigid with foot 7 and a second immobilization member 53 which is rigid with said pivotal mount 7*a*. The second immobilization member 53 is thus in a fixed position, since pivotal mount 7*a* is fixed.

Said first immobilization member 52 and said second immobilization member 53 are normally maintained spaced apart from one another by compression spring 54, when no one is sitting on seat 11, thus not interfering with rotation of the pane 6 (FIGS. 13-14).

Said first immobilization member 52 and said second immobilization member 53 are in mutual engagement and the compression spring 54 is compressed, when a user U is sitting on seat 11 (FIG. 12).

Said first immobilization member 52 and said second immobilization member 53 may be of circular shape centered on the axis of rotation Z0. For instance, said first immobilization member 52 and said second immobilization member 53 may be disk-shaped.

Said first immobilization member 52 and said second immobilization member 53 have mutually facing teeth 55, 56 adapted to engage mutually when the immobilization device 51 is in the immobilization position. For instance one of the two immobilization members 52, 53 (e.g. the second immobilization member 53) may have a circular toothing 56 axially facing the other one of the two immobilization members 52, 53 (e.g. the first immobilization member 52), and said other one of the two immobilization members 52, 53 has at least one tooth 55 (e.g. two diametrically opposed teeth 55 in the example shown) facing said circular toothing 56.

In the example shown in the drawings, the compression spring 54 is retained in mutually facing grooves 57, 57*a* formed respectively in the second immobilization member 53 and in the first immobilization member 52.

More generally, the sunshade 5 may include a movable actuation part which is spring biased upwardly toward a rest position, said movable actuation part being adapted to move downward to an actuation position under a weight of the user when said user is seated on said seat, and said movable actuation part is connected to the seat-activated immobilization device so that the movable actuation part puts the seat-activated immobilization device;

- in the rotation position when said movable actuation part is in the rest position,
- and in the immobilization position when said movable actuation part is in the actuation position.

In the above-described embodiment, the movable actuation part is the foot 7 of sunshade 5 but said movable actuation part could be any other part of sunshade 5.

For instance, the movable actuation part could be the seat 11 itself or another part (e.g. a link) connected to the seat 11. For example, seat 11 could be pivotally mounted on the shade 6 and could be spring-biased upward toward an upper position and could pivot downward to a lower (substantially horizontal) position when the user U seats on the seat 11. In that case, the seat 11 could actuate said link or other part to come into engagement with a fixed part of the sunshade 5 in order to immobilize the pane 6 when the seat 11 is in the lower position. For instance, the link or other part could have teeth coming into engagement with fixed teeth of the pivotal mount 7*a* when the seat 11 is in the lower position.

User-Controlled Immobilization Device

Figure 15:
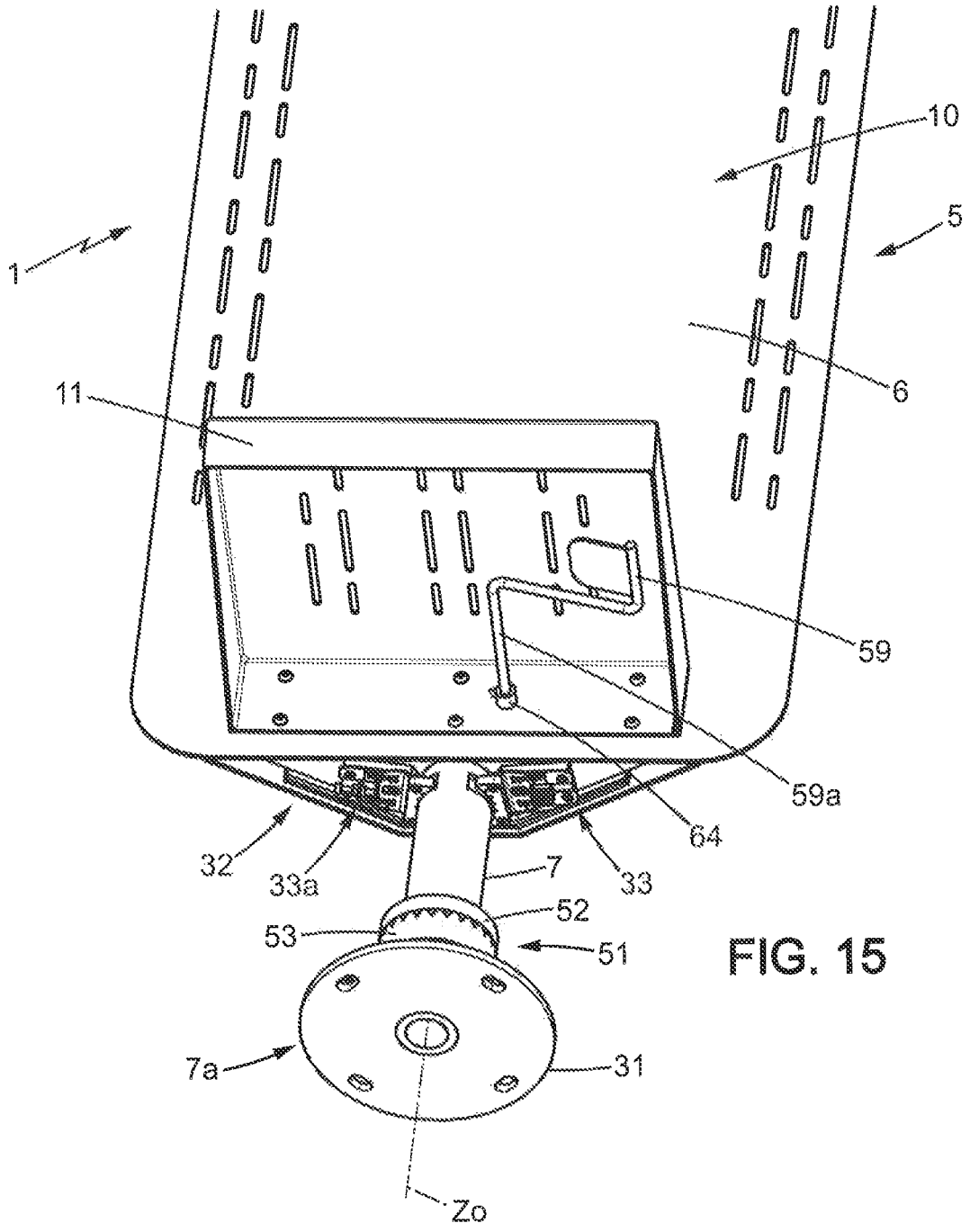
FIG. 15 is a perspective view, seen from below, of the sunshade of FIGS. 11-12.
Figure 16:
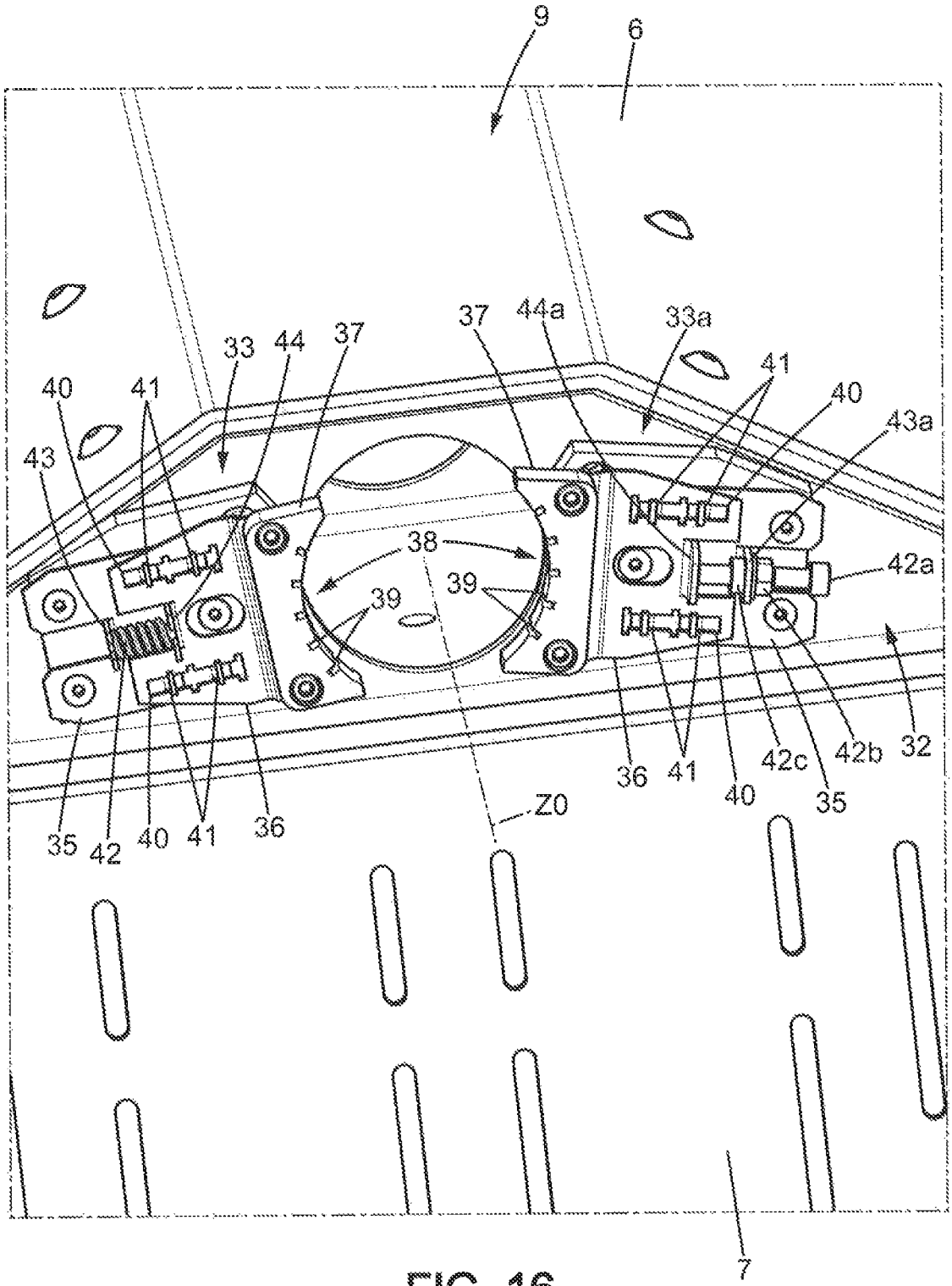
FIG. 16 is a detailed view showing a permanent braking system belonging to the sunshade of FIGS. 11-12.
Figure 17:
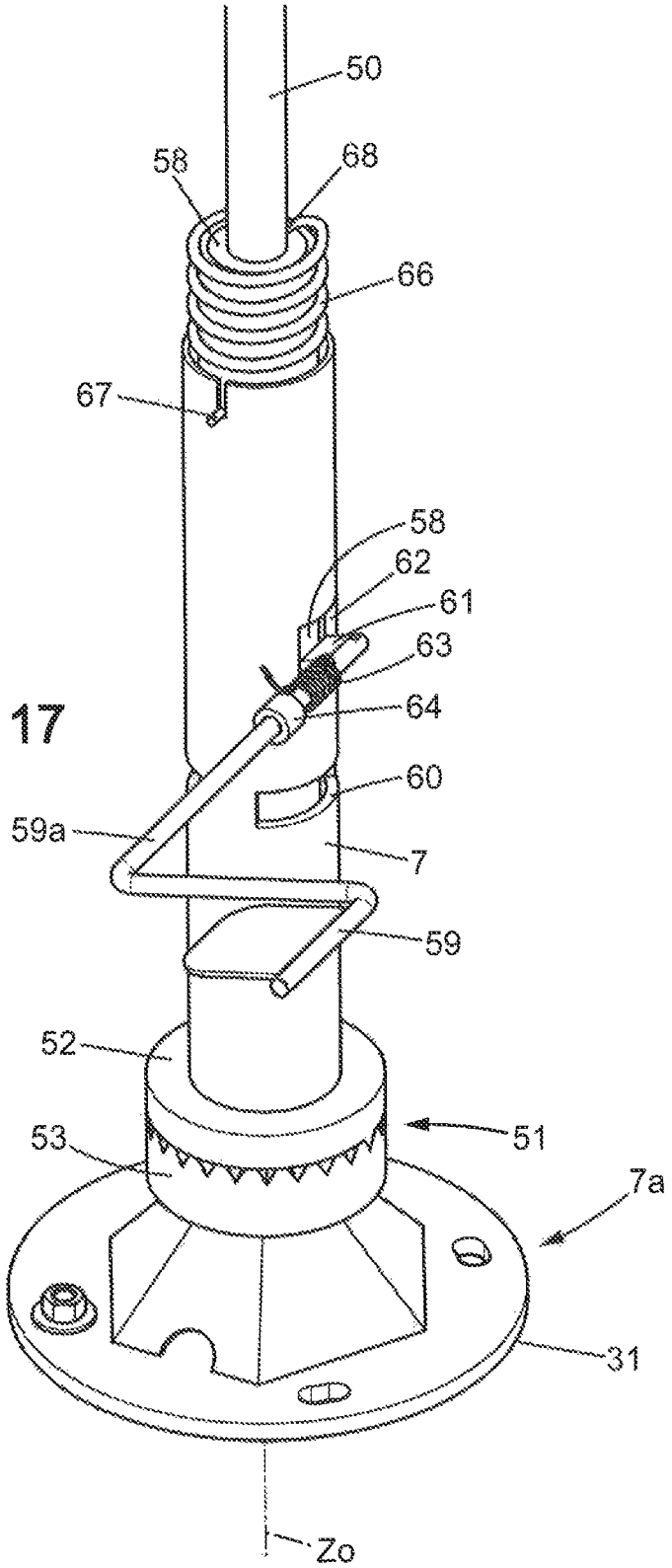
FIG. 17 is a detailed view showing a manually actuatable immobilization device of the sunshade of FIGS. 11-12.

The user-controlled immobilization device can be best seen on FIGS. 15, 17, 18.

The user-controlled immobilization device is movable between an immobilization position in which the immobilization device is adapted to immobilize said pane (FIGS.

15, 17, 18) and a rotation position in which the immobilization device enables rotation of said pane around said axis of rotation.

The sunshade 5 further includes an actuator 59 adapted to move the user-controlled immobilization device between said immobilization position and said rotation position, said actuator 59 being adapted to be controlled by the user.

Said user-controlled immobilization device is elastically biased toward the immobilization position, for instance by a spring 63.

Said user-controlled immobilization device may have a braking pad 61 and a circular braking track centered on said axis of rotation, said braking pad 61 being in contact with said circular braking track when the braking device is in the user-controlled immobilization position. The circular braking track may be part of the outside surface of post 58. The braking pad 61 may be an elastomeric or elastomer-coated part.

Said user-controlled immobilization device is adapted to apply a braking torque higher than 1 Nm, for instance higher than 10 Nm, when the immobilization device is in the immobilization position.

Said actuator 59 may be accessible to the user under the seat 11.

The actuator 59 may be a handle mounted under seat 11 and controlling a shaft 59*a*. Shaft 59*a* may extend horizontally and may be pivotally mounted on the pane 6 by at least a bearing 64. Said spring 63 may be for instance a coil spring disposed around shaft 59*a* and bearing at one end on part of the pane 6 and at the other end on part of the shaft 59*a* or of the braking pad 61, for instance.

Braking pad 61 may go through a window 62 of tubular foot 7, so as to bear on the post 58 as explained above.

When the handle 59 is actuated upwards by the user, it turns shaft 59*a* and braking pad 61 in the anti-clockwise direction in the example shown in the drawings, so that braking pad 61 is no more in contact with post 58 and thus does not exert any braking torque anymore on pane 6, so that pane 6 can be turned around the axis of rotation Z0 if the seat-activated immobilization system is not in the immobilization position.

Return System

The return system may include a return spring 66 biasing the pane 6, in rotation around the axis of rotation Z0, toward a rest angular position.

The return spring 66 may be a coil spring disposed around post 58, one end 67 of the coil spring being fixed to the foot 7 and the pane 6, while the other end 68 of the coil spring is fixed to the post 58 see FIG. 17).

Figure 11:
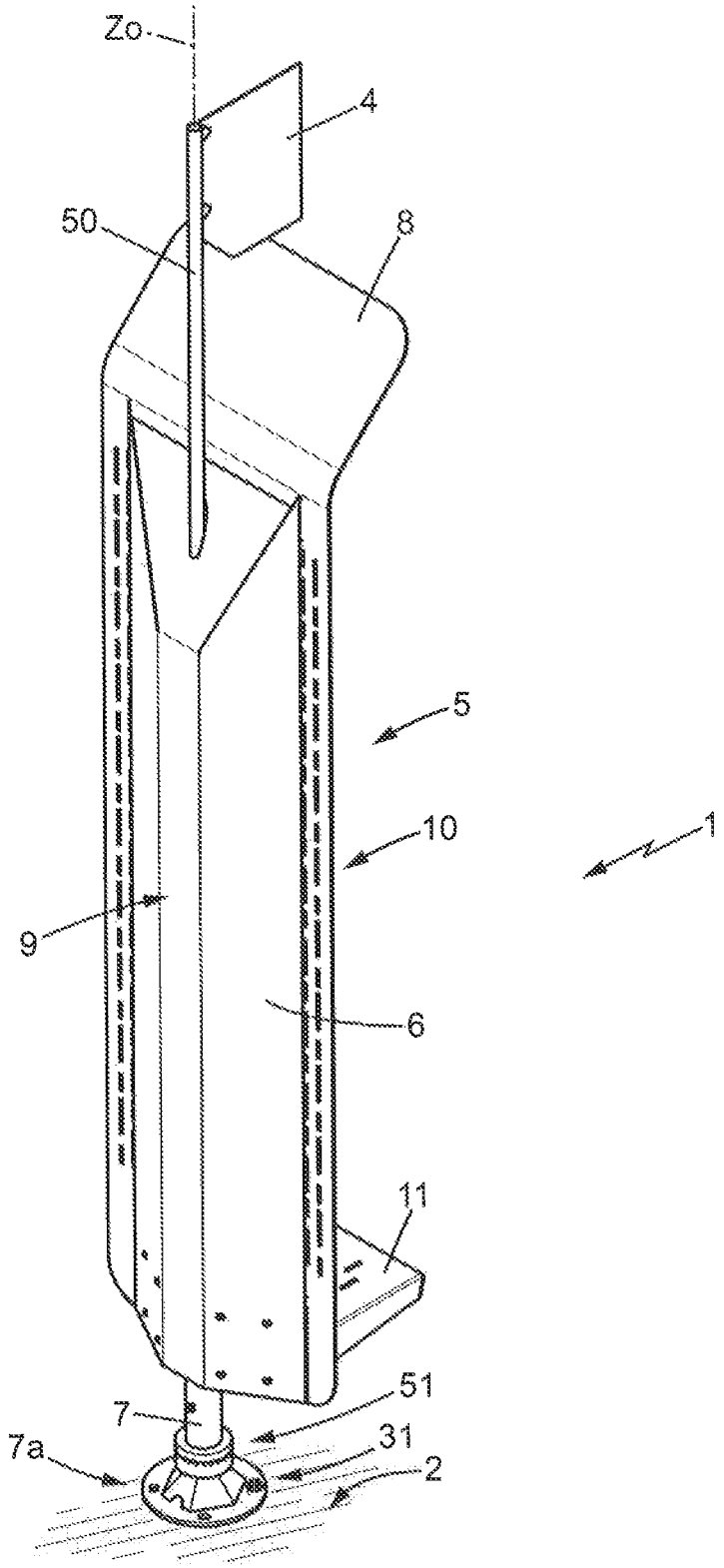
FIG. 11 is a schematic perspective view of a sixth embodiment.

The post 58 may include an upper part 50 extending upward further than the pane 6 (FIGS. 11, 18). This upper part may bear a signage 4 as described above, so that the signage is oriented in a fixed direction regardless of the angular position of pane 6.

Figure 19:
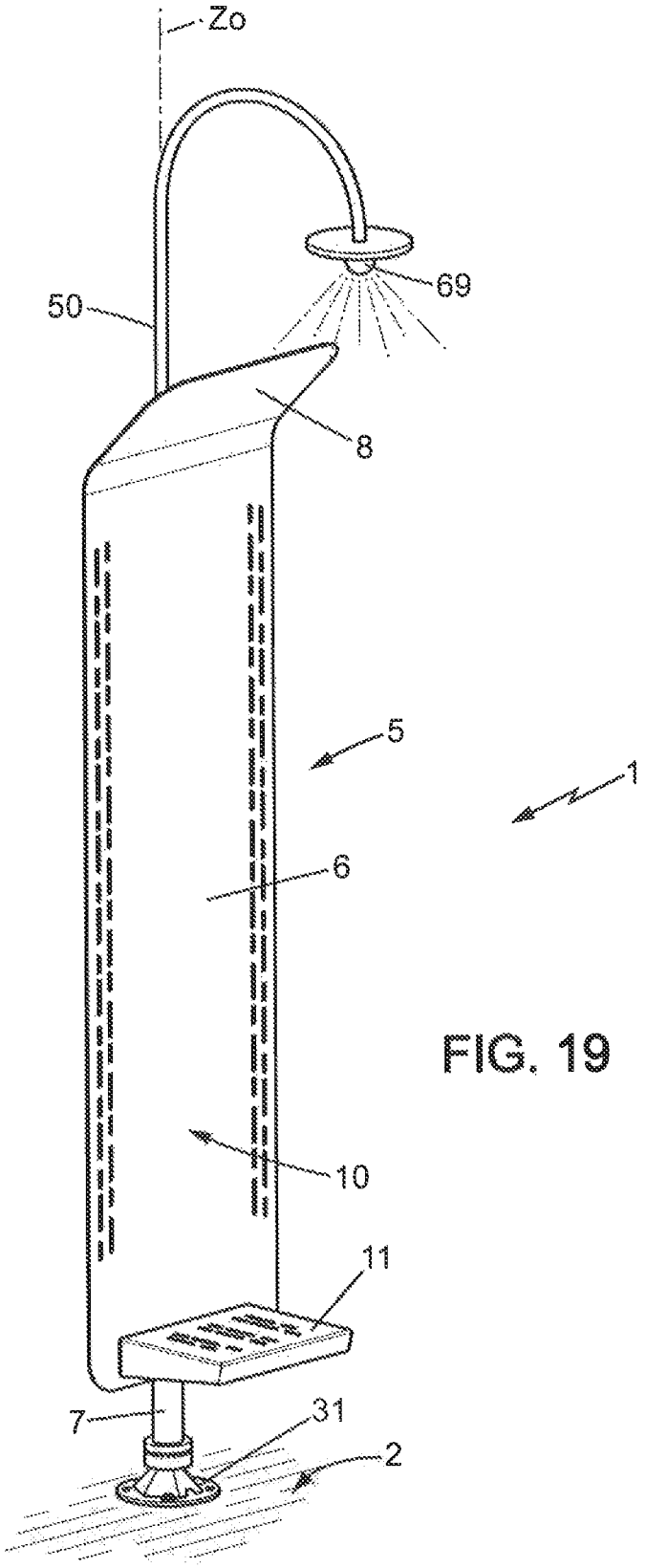
FIG. 19 is a schematic perspective view of a seventh embodiment.
Figure 20:
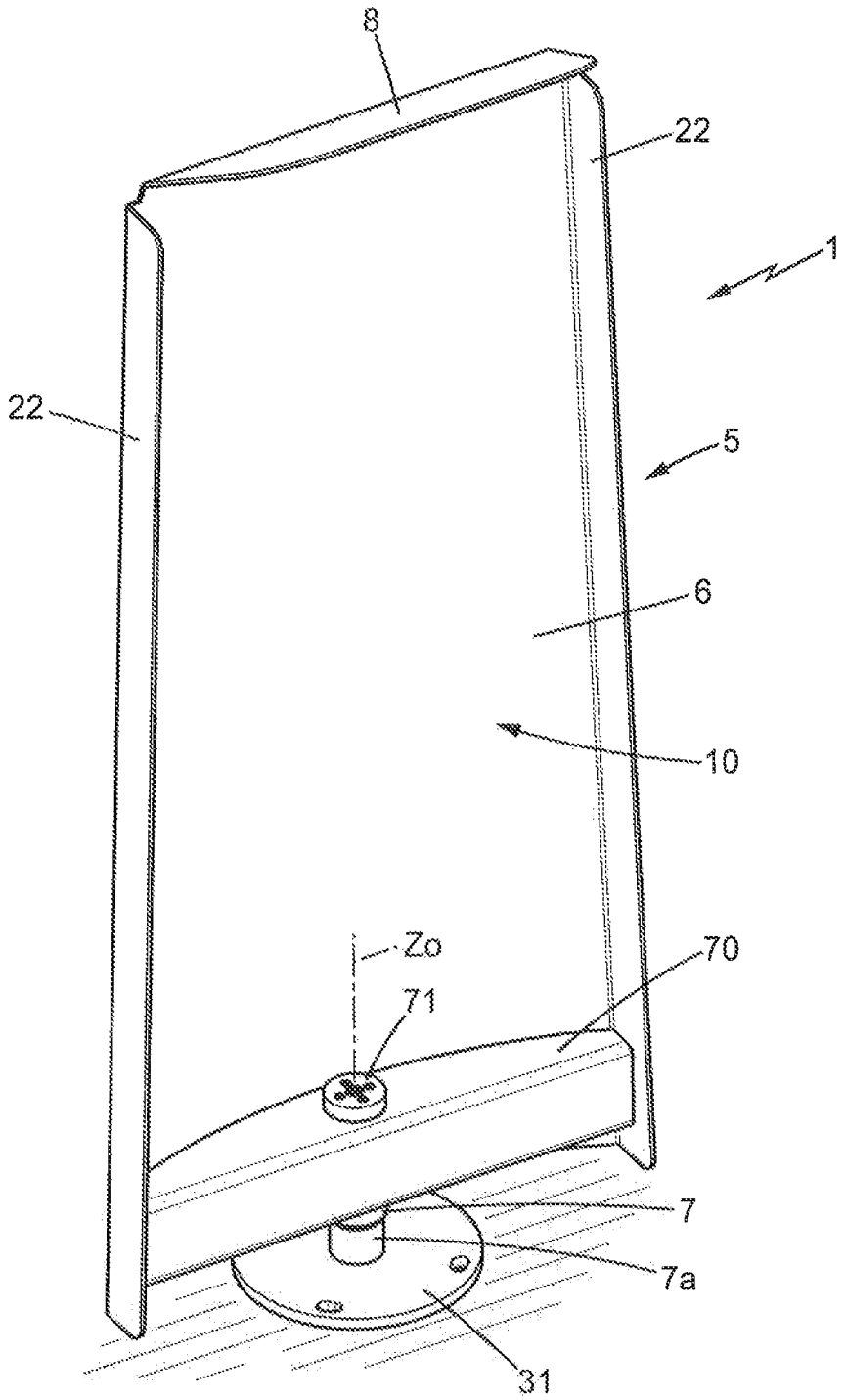
FIG. 20 is a schematic perspective view of an eighth embodiment.
Figure 21:
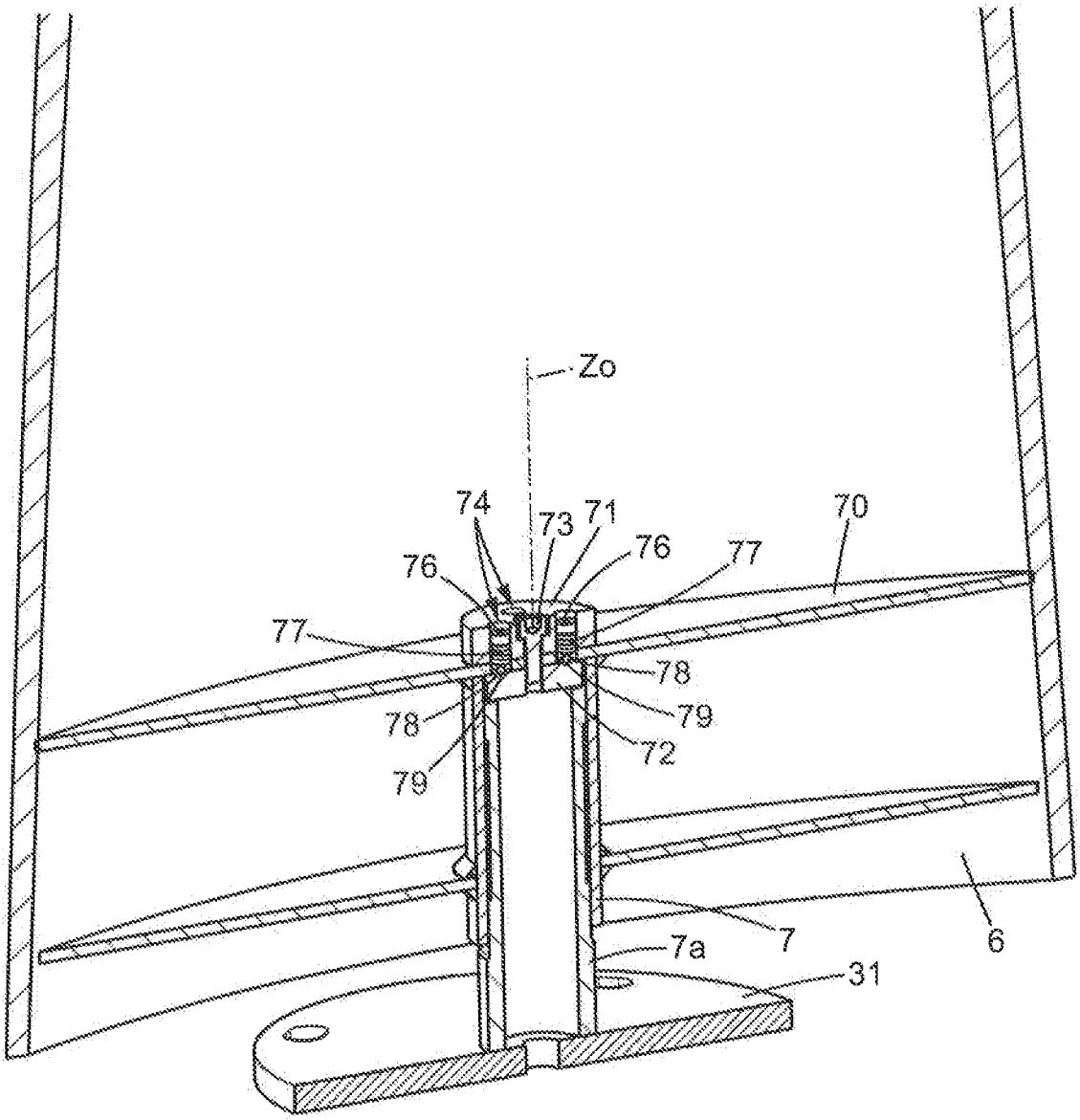
FIG. 21 shows a vertical section of the sunshade of FIG. 20.
Figure 22:
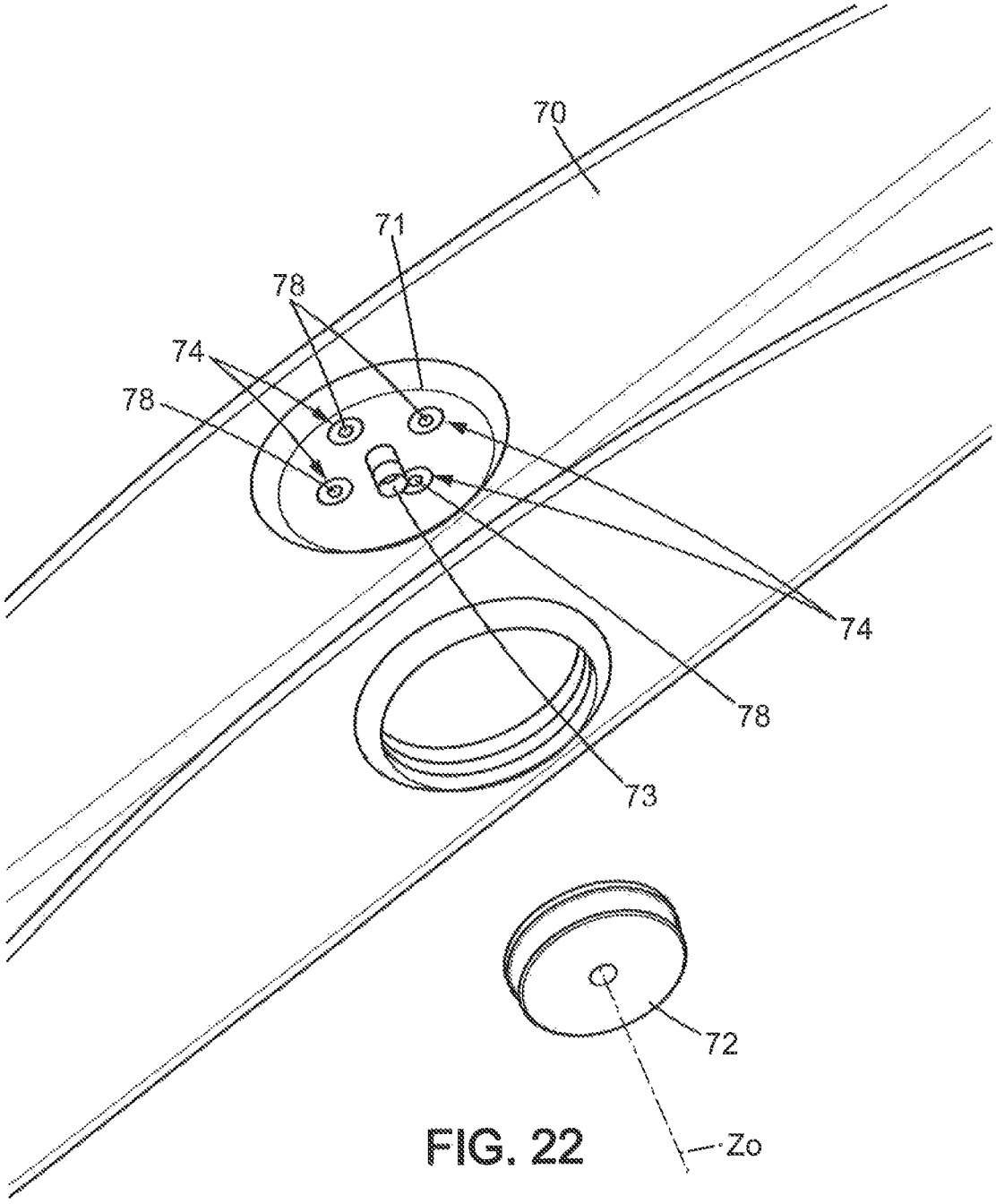
FIG. 22 is an exploded view of part of the sunshade of FIGS. 20-21, viewed from below.
Figure 23:
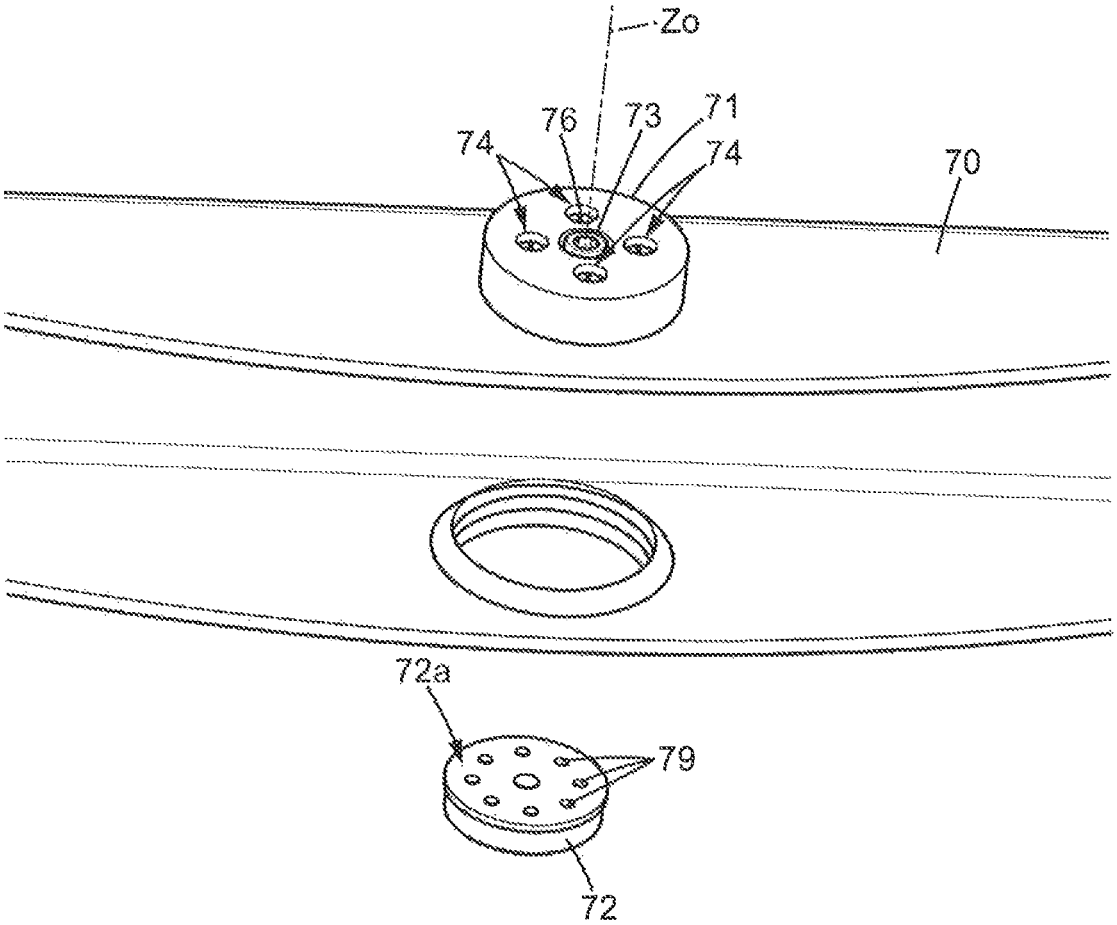
FIG. 23 is an exploded view of part of the sunshade of FIGS. 20-21, viewed from above.

The seventh embodiment, shown in FIG. 19, is similar to the sixth embodiment, but differs from the sixth embodiment in that the upper part 50 of post 58 bears a lighting 69. Of course, the upper part 50 of post 58 could bear both a signage 4 and a lighting 69.

The lighting 69 may be electrically fed from any source of energy (e.g. the mains and/or a battery charged by a solar panel, or else). If the pane 6 includes electrical equipment as discussed for previous embodiments, such electrical equipment may be fed from said source of energy.

In the eighth embodiment, shown in FIGS. 20-23, the rotation control apparatus includes an indexing device 71, 72 adapted to index the pane 6 in at least one predetermined angular position, for instance in a finite number n of angular positions (n=8 in the example shown).

Said indexing device may have a circular track 72*a* centered on the axis of rotation Z0 and at least one pusher 78 elastically biased against the circular track 72*a*, said circular track 72*a* having at least one recess 79 adapted to receive the pusher 78 when the pusher 78 is angularly in register with the recess 79, said circular track 72*a* and said at least one pusher 78 being mounted so that when the pane 6 is rotated, said at least one pusher 78 and said circular track 72*a* have a relative movement of rotation around the rotation axis Z0.

In the particular example shown in FIGS. 20-23, pivotal mount 7*a* may extend upward from pedestal 31 to which it is secured. The foot 7 of the pane may be a tubular member fit on the pivotal mount 7*a* and unitary with pane 6. For instance, pane 6 may include a lower cross-member 70 which is fixed to the foot 7.

The indexing device may include two disk-shaped elements, to wit a first index element 71 and a second indexing element 72. The first index element 71 may be secured to the cross-member 70. The second indexing element 72 may be disposed below the first indexing element 71 and secured to the pivotal mount 7*a*.

The first indexing element 71 is pivotally mounted on the second indexing element 72 around the axis of rotation Z0, for instance through a bolt or screw 73.

The upper face of the second indexing element 72 may form said circular track 72*a* with said recesses 79 formed therein, for instance n recesses 79 as defined above, regularly angularly disposed around the axis of rotation Z0.

The first indexing element 71 may have axial bores 74 formed therein, each bore 74 having pushers 78 such as balls which are vertically slidably mounted therein. The upper end of the bores 74 may be closed by a cap 76 and a spring 77 may be contained in the bore 74 and interposed between the cap 76 and the pusher 78 so as to bias the pusher 78 downward. The lower end of the bores 74 may have a restriction or other abutment maintaining the pushers 78 in the bores 74, while enabling the pushers to protrude enough downward to penetrate in the recesses 79. The first indexing element 71 may have four bores 74 and thus four pushers angularly disposed at 90 degrees from one another around the axis of rotation Z0, in the example shown in the drawings.

The indexing device 71, 72 is adapted to maintain the pane 6 in said at least one predetermined angular position as long as the pane 6 is not submitted to a minimum torque in rotation around the axis of rotation Z0. Said minimum torque may be comprised between 1 and 15 Nm.

Other Variants

In all embodiments, the seat 11 may be either a fixedly horizontal seat, or a jump seat. Also, the seat 11 can be a standing seat.

The sunshade (whatever the embodiment) can be attached to existing, fixed vertical pole structures such as street pedestrian light poles and other vertical elements. The sunshade system can be a kit of part to be retrofitted to attached directly to an existing specific pole or engineered to be fully integrated as part of a new pole design.

In all embodiments, the pivotal mount 7*a* could be any mount enabling the pane to rotate about a vertical axis of rotation Z0. The vertical axis of rotation Z0 can be fixed or not during the course of rotation of the shade.

For instance, such mount can be equipped with a vertical screw on which a part unitary with the shade 5 is engaged: in that case, the axis of rotation Z0 may be immovable but the pane 5 slightly moves vertically as said shade 5 is rotated about the axis of rotation Z0. The amplitude of the movement of rotation may be limited by abutments, as previously described.

The invention claimed is:

1. A sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said sunshade further includes a rotation control apparatus adapted to control said rotation of said pane, wherein said rotation control apparatus is adapted to brake said rotation of said pane by friction, wherein said pane is of substantially elongate shape, with a height extending longitudinally, substantially parallel to the axis of rotation, between a lower end and an upper end, wherein said rotation control apparatus includes a braking device having a braking pad in contact with a circular braking track centered on said axis of rotation, and wherein said braking pad has a braking face in contact with the circular braking track, said braking face having grooves formed therein.

2. The sunshade according to claim 1, wherein said rotation control apparatus is adapted to apply a braking torque comprised between 1 and 15 Nm.

3. The sunshade according to claim 1, wherein said braking pad is elastically biased against said circular braking track.

4. The sunshade according to claim 1, wherein said braking pad is elastomeric.

5. The sunshade according to claim 1, wherein said grooves extend substantially parallel to the axis of rotation.

6. A sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said sunshade further includes a rotation control apparatus adapted to control said rotation of said pane, wherein said rotation control apparatus is adapted to brake said rotation of said pane by friction, wherein said pane is of substantially elongate shape, with a height extending longitudinally, substantially parallel to the axis of rotation, between a lower end and an upper end, wherein said rotation control apparatus includes:

a user-controlled immobilization device movable between an immobilization position in which the user-controlled immobilization device is adapted to brake said pane by friction and a rotation position in which the immobilization device enables rotation of said pane around said axis of rotation;

and an actuator adapted to move the user-controlled immobilization device between said immobilization position and said rotation position, said actuator being adapted to be controlled by a user, and wherein said user-controlled immobilization device is elastically biased toward the immobilization position.

7. The sunshade according to claim 6, wherein said user-controlled immobilization device has a braking pad and a circular braking track centered on said axis of rotation, said braking pad being in contact with said circular braking track when the user-controlled immobilization device is in the immobilization position.

8. The sunshade according to claim 7, wherein said user-controlled immobilization device is adapted to apply a braking torque higher than 1 Nm when the user-controlled immobilization device is in the immobilization position.

9. The sunshade according to claim 6, wherein said pane has a seat and said actuator is accessible to a user under said seat.

10. A sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said sunshade further includes a rotation control apparatus adapted to control said rotation of said pane, wherein said rotation control apparatus includes a seat-activated immobilization device which is movable between an immobilization position in which the seat-activated immobilization device is adapted to immobilize said pane and a rotation position in which the seat-activated immobilization device enables rotation of said pane around said axis of rotation, said sunshade having a seat for a user, said sunshade including a movable actuation part which is spring biased upwardly toward a rest position, said movable actuation part being adapted to move downward to an actuation position under a weight of the user when said user is seated on said seat, and said movable actuation part is connected to the seat-activated immobilization device so that the movable actuation part puts the seat-activated immobilization device:

in the rotation position when said movable actuation part is in the rest position, and in the immobilization position when said movable actuation part is in the actuation position.

11. The sunshade according to claim 10, wherein said seat-activated immobilization device includes a first immobilization member which is rigid with said movable actuation part and a second immobilization member which is rigid with said mount, said first immobilization member and said second immobilization member being maintained spaced apart from one another by a compression spring when the movable actuation part is in the actuation position, said first immobilization member and said second immobilization member being in mutual engagement and the compression spring is compressed, when the movable actuation part is in the rest position.

12. The sunshade according to claim 11, wherein said first immobilization member and said second immobilization member have mutually facing teeth adapted to engage mutually when the seat-activated immobilization device is in the immobilization position.

13. A sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said sunshade further includes a rotation control apparatus adapted to control said rotation of said pane, wherein said pane has a rest angular position and said rotation control apparatus includes a return spring biasing the pane in rotation around said axis of rotation toward said rest angular position.

14. A sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said sunshade further includes a rotation control apparatus adapted to control said rotation of said pane, wherein said rotation control apparatus is adapted to limit by abutment a rotation amplitude of the pane around the rotation axis.

15. A sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said sunshade further includes a rotation control apparatus adapted to control said rotation of said pane, wherein said rotation control apparatus is adapted to brake said rotation of said pane by friction, wherein said pane is of substantially elongate shape, with a height extending longitudinally, substantially parallel to the axis of rotation, between a lower end and an upper end, wherein said rotation control apparatus includes a braking device having a braking pad in contact with a circular braking track centered on said axis of rotation, and wherein said braking pad is adjustable in position relative to said circular braking track.

16. The sunshade according to claim 15, wherein said rotation control apparatus is adapted to apply a braking torque comprised between 1 and 15 Nm.

17. A sunshade for an outdoor public space having a bottom surface, said sunshade including:

a pane adapted to provide at least partial shade from sunlight;

a mount adapted to be fixed to the bottom surface of the outdoor public space and supporting said pane so that said pane is orientable by rotation about an axis of rotation which is substantially vertical when said mount is fixed to the bottom surface, wherein said sunshade further includes a rotation control apparatus adapted to control said rotation of said pane, wherein said rotation control apparatus is adapted to brake said rotation of said pane by friction, wherein said pane is of substantially elongate shape, with a height extending longitudinally, substantially parallel to the axis of rotation, between a lower end and an upper end, wherein said rotation control apparatus includes a braking device having a braking pad in contact with a circular braking track centered on said axis of rotation, and wherein said circular braking track faces radially outwardly relative to the axis of rotation and said braking pad bears radially inwardly against said circular braking track.

18. A sunshade according to claim 17, further having a post adapted to be fixed to the bottom surface and extending along said rotation axis, said pane being able to rotate around said post while said post is fixed.

19. The sunshade of claim 18, wherein said post supports a signage.

20. The sunshade according to claim 17, wherein said outdoor public space includes a public transportation station and said sunshade is installed at said public transportation station.

21. An outdoor public space having a bottom surface and the sunshade of claim 17.

22. The outdoor public space according to claim 21, further including a public transportation station.

23. The sunshade according to claim 17, wherein said braking pad is elastically biased against said circular braking track.

24. The sunshade according to claim 17, further including an additional braking device having an additional braking pad bearing radially inwardly on said circular braking track.

25. The sunshade according to claim 24, wherein said bearing braking pad is elastically biased against said circular braking track and said additional braking pad is adjustable in position relative to said circular braking track.

26. The sunshade according to claim 25, wherein said bearing braking pad and said additional braking pad are substantially opposed relative to the axis of rotation.

27. The sunshade according to claim 17, wherein said circular braking track belongs to a post which at least partially supports said pane.

28. The sunshade of claim 27, wherein said post supports a further structural element.

29. The sunshade of claim 28, wherein said further structural element includes a signage.

30. The sunshade according to claim 17, wherein said rotation control apparatus is adapted to apply a braking torque comprised between 1 and 15 Nm.

31. The sunshade according to claim 17, wherein said pane is made from an opaque material having holes which let through part of the sunlight.

* * * * *